US009738475B2

(12) United States Patent
Sato et al.

(10) Patent No.: US 9,738,475 B2
(45) Date of Patent: Aug. 22, 2017

(54) MEDIUM CONVEYING DEVICE AND MEDIUM TRANSACTION DEVICE

(71) Applicant: Oki Electric Industry Co., Ltd., Tokyo (JP)

(72) Inventors: Yoshinori Sato, Tokyo (JP); Hajime Togiya, Tokyo (JP)

(73) Assignee: Oki Electric Industry Co., Ltd., Tokyo (JP)

( * ) Notice: Subject to any disclaimer, the term of this patent is extended or adjusted under 35 U.S.C. 154(b) by 0 days.

(21) Appl. No.: 14/907,312

(22) PCT Filed: Jun. 4, 2014

(86) PCT No.: PCT/JP2014/064876
§ 371 (c)(1),
(2) Date: Jan. 25, 2016

(87) PCT Pub. No.: WO2015/040897
PCT Pub. Date: Mar. 26, 2015

(65) Prior Publication Data

US 2016/0167906 A1 Jun. 16, 2016

(30) Foreign Application Priority Data

Sep. 19, 2013 (JP) ..... 2013-194600

(51) Int. Cl.

| | |
|---|---|
| ***B65H 5/02*** | (2006.01) |
| ***B65H 9/06*** | (2006.01) |
| ***G07D 11/00*** | (2006.01) |
| ***B65H 5/38*** | (2006.01) |

(52) U.S. Cl.
CPC ..... *B65H 9/06* (2013.01); *B65H 5/021* (2013.01); *B65H 5/023* (2013.01); *B65H 5/025* (2013.01); *B65H 5/38* (2013.01); *G07D 11/0018* (2013.01); *B65H 2404/513* (2013.01); *B65H 2701/1912* (2013.01)

(58) Field of Classification Search
CPC ..... B65H 5/02; B65H 5/021; B65H 5/023; B65H 5/025; B65H 5/026; B65H 5/38; B65H 5/36; B65H 2407/1912; G07D 11/0018; G07D 11/0021
See application file for complete search history.

(56) References Cited

U.S. PATENT DOCUMENTS 7,900,916 B2 * 3/2011 Sugahara ..... B65H 29/52 271/207

FOREIGN PATENT DOCUMENTS

| | | | |
|---|---|---|---|
| JP | 09208084 A | * | 8/1997 |
| JP | 2001-118115 A | | 4/2001 |
| JP | 2002351037 A | * | 12/2002 |
| JP | 2004277104 A | * | 10/2004 |

(Continued)

*Primary Examiner* — Luis A Gonzalez
(74) *Attorney, Agent, or Firm* — Rabin & Berdo, P.C.

(57) ABSTRACT

A medium conveyance device including: a conveyance guide that defines a conveyance space through which a paper sheet shaped medium should pass when conveying the medium along a conveyance direction; and an outside region that is a region, out of a guide face forming a boundary face to the conveyance space in the conveyance guide, contacted by an end portion of the medium in an orthogonal direction orthogonal to the conveyance direction, and that guides the end portion of the medium to so as to be positioned inside the conveyance space.

4 Claims, 16 Drawing Sheets

(56) References Cited

FOREIGN PATENT DOCUMENTS

| | | | | |
|---|---|---|---|---|
| JP | 2008-059521 | A | | 3/2008 |
| JP | 2010039831 | A | * | 2/2010 |
| JP | 2013-080500 | A | | 5/2013 |

* cited by examiner

MEDIUM CONVEYING DEVICE AND MEDIUM TRANSACTION DEVICE

TECHNICAL FIELD

The present invention relates to a medium conveyance device and a medium transaction device, and is, for example, well-suited to application to an Automated Teller Machine (ATM) that is input with a paper sheet shaped medium such as banknotes, and performs desired transactions.

BACKGROUND ART

Hitherto, ATMs such as those employed in financial institutions, allow a customer to pay in cash, such as coins and banknotes, and pay out cash to a customer, according to the contents of a customer transaction.

For example, ATMs have been proposed including a customer interface that exchanges banknotes with a customer, a conveyance section that conveys banknotes, a classification section that classifies inserted banknotes by denomination and authenticity, a temporary holding section that temporarily holds inserted banknotes, banknote cassettes that store banknotes by denomination, and a reject cassette that stores banknotes that are not suitable for reuse.

In such an ATM, during a pay-in transaction, when banknotes are inserted into the customer interface by a customer, the inserted banknotes are conveyed to the classification section by a conveyance section and classified, and banknotes classified as normal banknotes are stored in the temporary holding section, and banknotes determined to be unsuitable for transaction are replaced in the customer interface and returned to the customer.

The ATM then confirms the amount to be deposited by the customer, feeds out the banknotes stored in the temporary holding section for the classification section to reclassify the denomination, stores each of the banknotes in the banknote cassettes according to their classified denomination, and stores banknotes determined to have a high degree of damage in the reject cassette.

In pay-out processing, when an amount to be paid out has been confirmed by operation instruction by the customer, the ATM feeds out banknotes from the banknote cassettes corresponding to the amount to be paid out, and conveys the banknotes using the conveyance section, and after the classification section has determined that the correct number of normal banknotes has been fed out, the banknotes are conveyed to the user interface to be taken by the customer.

Such conveyance sections include conveyance sections in which two conveyance guides that guide banknotes are disposed facing each other, with the gap therebetween configuring a banknote conveyance path. As such a conveyance guide, conveyance guides have been proposed in which plural ribs running along the banknote conveyance direction project out discretely in an orthogonal direction that is orthogonal to the conveyance direction, thereby reducing the contact surface area with the banknotes to achieve smoother conveyance of banknotes by reducing the contact resistance (see, for example, Japanese Patent Application Laid-Open (JP-A) No. 2001-118115 (FIG. 1)).

SUMMARY OF INVENTION

Technical Problem

Recently, banknotes made from polymer resins (referred to below as polymer banknotes) are sometimes employed in place of conventional banknotes made from paper (referred to below as paper-based banknotes), with the intention of raising strength and increasing durability.

Polymer banknotes are designed to be handled in a similar manner to paper-based banknotes, and are therefore comparatively soft, and are creased and form wrinkles easily. Accordingly, similarly to paper-based banknotes, when polymer banknotes are conveyed by a conveyance section, they are not necessarily flat, and are sometimes curved or creased to some extent.

From the perspectives of the complexity of rib shapes and reducing manufacturing costs, conveyance guides of conveyance sections are, for example, produced by injection molding a resin material. Accordingly, as illustrated in cross-section in FIG. 17, for example, during conveyance, if orthogonal direction end portions of banknotes BL, these being polymer banknotes, travel in contact with, namely rub against, a side face of a rib 431R of a conveyance guide 431, the side face of the rib 431R could be worn away due to friction.

Accordingly, in the conveyance section, if such rubbing of the side faces of ribs by end portions of polymer banknotes occurs repeatedly, there is a concern of the shape of the ribs changing as a result of wear, such that banknotes can no longer be guided correctly, resulting in the occurrence of faults such as banknote blockages (known as jams).

In consideration of the above circumstances, the present invention proposes a medium conveyance device and a medium transaction device capable of increased durability.

Solution to Problem

A first aspect of the present invention provides a medium conveyance device including a conveyance guide that defines a conveyance space through which a paper sheet shaped medium should pass when conveying the medium along a conveyance direction; and an outside region that is a region, out of a guide face forming a boundary face to the conveyance space in the conveyance guide, contacted by an end portion of the medium in an orthogonal direction orthogonal to the conveyance direction, and that guides the end portion of the medium to so as to be positioned inside the conveyance space.

This thereby enables conveyance in which an orthogonal direction end face of the medium does not rub against the conveyance guide in the outside region in which the orthogonal direction end portion of the medium being conveyed through the conveyance space is positioned.

A second aspect of the present invention provides a medium transaction device that passes a transacted paper sheet shaped medium between a first conveyance section and a second conveyance section, wherein: the first conveyance section includes a first conveyance guide that defines a conveyance space through which a paper sheet shaped medium should pass when conveying the medium along a conveyance direction, and a first outside region that is a region, out of a first guide face forming a boundary face to the conveyance space in the first conveyance guide, contacted by an end portion of the medium in an orthogonal direction orthogonal to the conveyance direction, and that guides the end portion of the medium to so as to be positioned inside the conveyance space; the second conveyance section includes a second conveyance guide that is disposed adjacent to the first conveyance guide along the conveyance direction, and that includes a second guide face contiguous to the first guide face and configuring a boundary face to the conveyance space, and a second outside region that is a region out of the second guide face that is contacted by the orthogonal direction end portion of the medium, and that guides the end portion of the medium so as to be positioned inside the conveyance space.

This thereby enables conveyance in which an orthogonal direction end face of the medium does not rub against the first conveyance guide and the second conveyance guide in the first outside region and the second outside region in which the orthogonal direction end portion of the medium being conveyed through the conveyance space is positioned.

Advantageous Effects of Invention

The present invention enables conveyance in which the orthogonal direction end portion of the medium does not rub against the conveyance guide in the outside region in which the orthogonal direction end portion of the medium being conveyed in the conveyance space is positioned. The present invention moreover enables conveyance in which the orthogonal direction end portion of the medium does not rub against the first conveyance guide and the second conveyance guide in the first outside region and the second outside region in which the orthogonal direction end portion of the medium being conveyed in the conveyance space is positioned. The present invention accordingly enables a medium conveyance device and a medium transaction device capable of increased durability.

DESCRIPTION OF EMBODIMENTS

Explanation follows regarding embodiments of the present invention (referred to below as exemplary embodiments), with reference to the drawings.

1. First Exemplary Embodiment

1-1. Automated Teller Machine Overall Configuration

Figure 1:
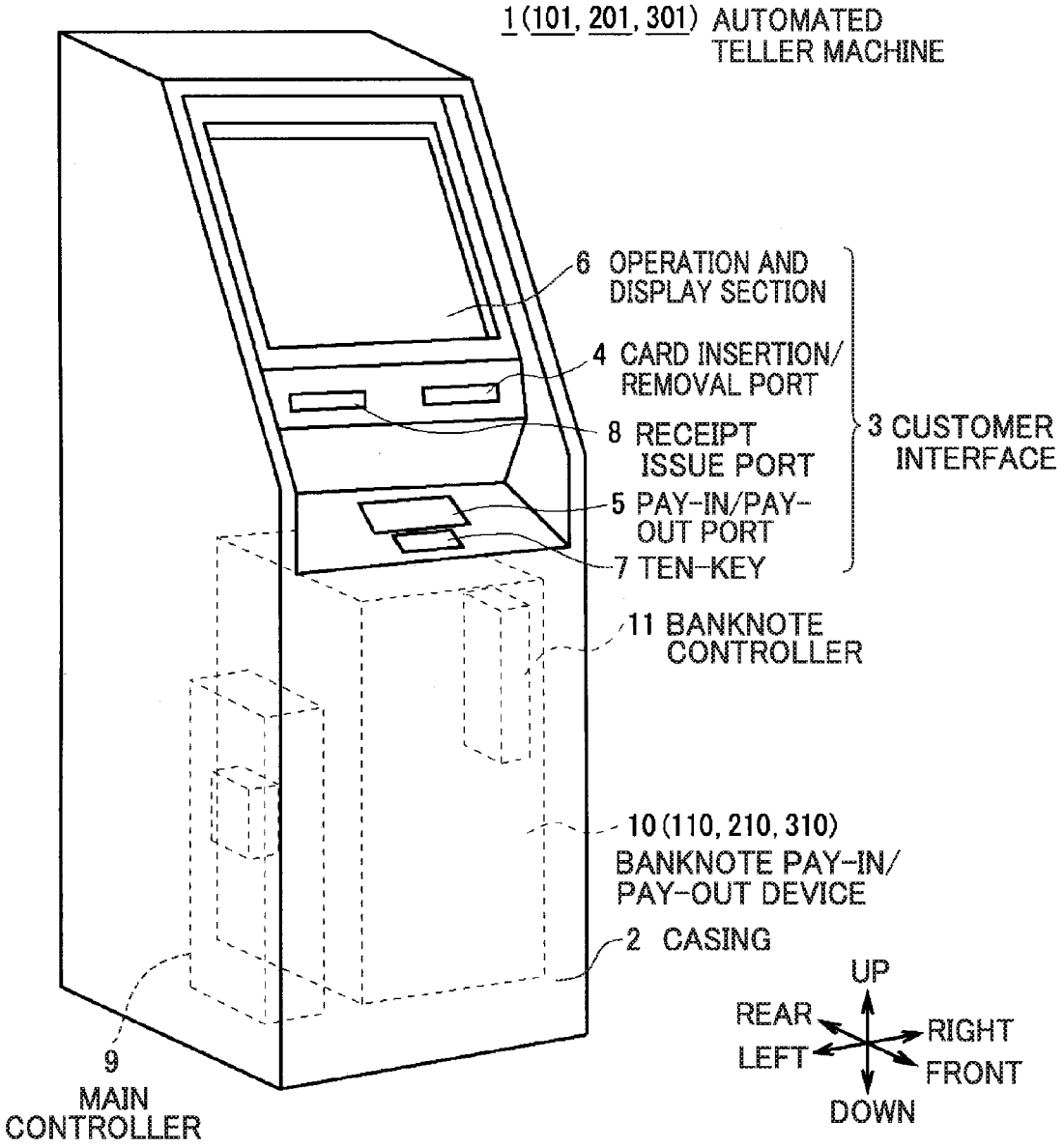
FIG. 1 is a schematic line drawing illustrating a configuration of an ATM.

As illustrated in the external view of FIG. 1, an automated teller machine 1 is configured around a box shaped casing 2, and is installed, such as in a financial institution, to perform cash transactions such as pay-in transactions and pay-out transactions with a customer.

The casing 2 is configured with a diagonally cut-away shape at a location enabling easy banknote insertion and easy operation of a touch panel by a customer facing the front side of the casing 2, namely at a portion spanning from a front face upper portion to the top face, with a customer interface 3 provided at this portion.

The customer interface 3 is, for example, configured to directly handle cash and passbook transactions with a customer, as well as to notify transaction-related information and receive operation instructions. The customer interface 3 is provided with a card insertion/removal port 4, a pay-in/pay-out port 5, an operation and display section 6, a ten-key 7, and a receipt issue port 8.

The card insertion/removal port 4 is a portion for insertion and return of various cards, such as cash cards. A card processor (not illustrated in the drawings) that reads, for example, account numbers magnetically recorded on the various cards is provided behind the card insertion/removal port 4. The pay-in/pay-out port 5 is a section into which banknotes for paying in are inserted by a customer, and where banknotes BL for paying out to a customer are dispensed. The pay-in/pay-out port 5 is moreover opened up, or closed off, by driving a shutter.

The operation and display section 6 is a touch panel integrated with a Liquid Crystal Display (LCD) that displays operation screens during transactions, and a touch sensor that is input with, for example, a transaction type selection, a PIN, or a transaction amount. The ten-key 7 is a physical keypad that is input with the numbers 0 to 9. The ten-key 7 is employed during PIN and transaction amount input operations. The receipt issue port 8 is a section that issues a receipt printed with transaction details and the like at the end of transaction processing. A receipt processor (not illustrated in the drawings) that prints the transaction details and the like on the receipt is, for example, provided behind the receipt issue port 8.

In the following explanation of the automated teller machine 1, the front side is defined as the side facing a customer, and the rear side is defined as the opposite side thereto. The left side, right side, and also the upper side and lower side are respectively defined from the perspective of left and right as seen by a customer facing the front side.

For example, a main controller 9 that performs integrated control of the overall automated teller machine 1, and a banknote pay-in/pay-out device 10 that performs various processing relating to banknotes, are provided inside the casing 2. The main controller 9 is configured around a Central Processing Unit (CPU), not illustrated in the drawings. The main controller 9 reads and executes specific programs from, for example, ROM or flash memory, not illustrated in the drawings, to perform various processing in pay-in transactions and pay-out transactions. Inside the main controller 9 is a storage section configured by, for example, Random Access Memory (RAM), a hard disk drive, and flash memory. The storage section is stored with various information.

Open-and-closable doors are provided, for example, at portions of side faces, such as on the front face side or rear face side of the casing 2. Namely, as illustrated in FIG. 1, during cash transactions with customers, the respective doors are closed such that the banknotes stored inside the banknote pay-in/pay-out device 10 are protected by the casing 2. However, during maintenance operations performed by an operator, the respective doors of the casing 2 are opened as required, enabling easy completion of tasks on each internal portion.

Figure 2:
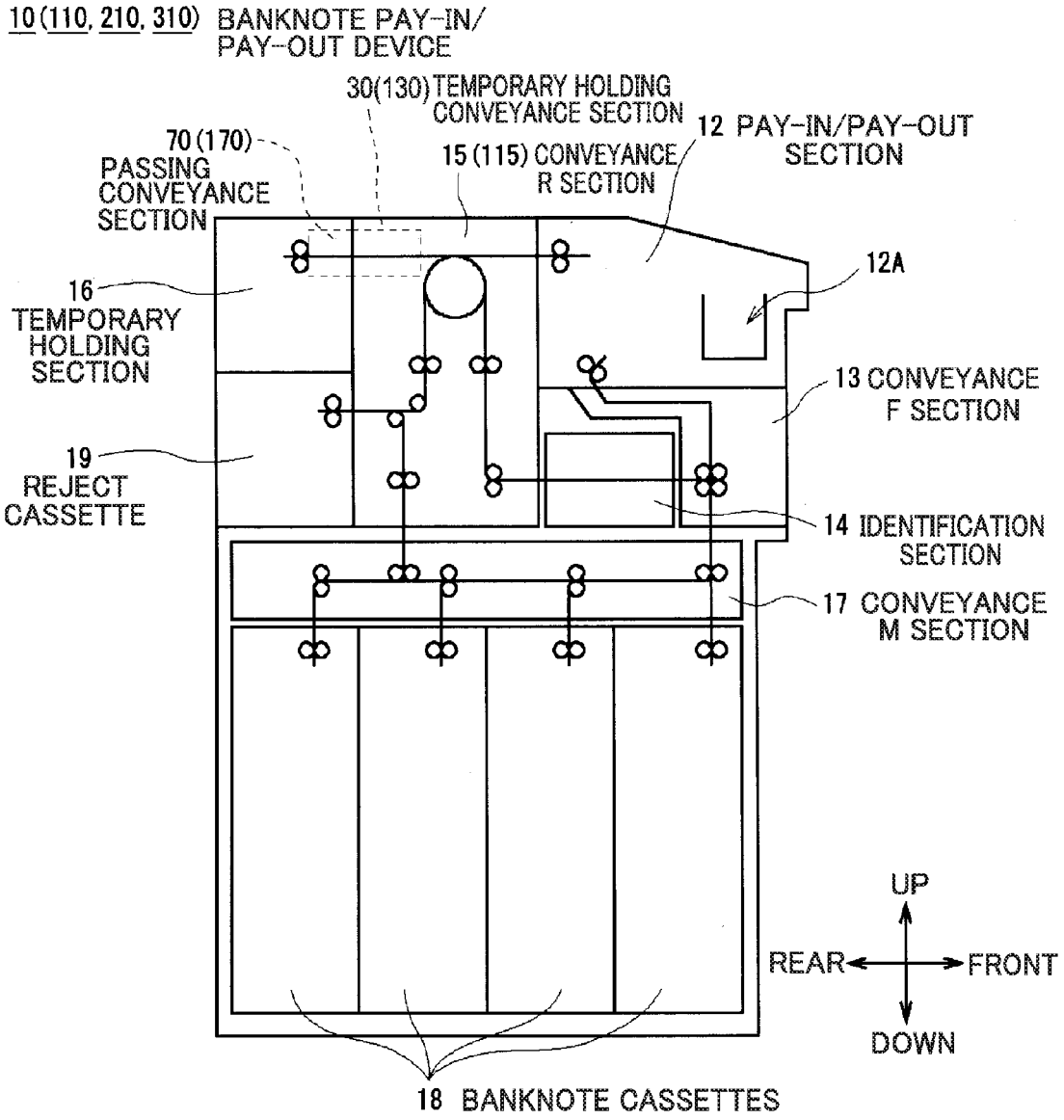
FIG. 2 is a schematic line drawing illustrating a configuration of a banknote pay-in/pay-out device.

As illustrated in the side view of FIG. 2, plural sections that perform various processing relating to banknotes are incorporated inside the banknote pay-in/pay-out device 10. A banknote controller 11 controls each section of the banknote pay-in/pay-out device 10.

The banknote controller 11 is configured around a CPU, not illustrated in the drawings, similarly to the main controller 9. The banknote controller 11 reads and executes specific programs, such as from ROM or flash memory, not illustrated in the drawings, in order to perform various processing, such as processing to decide a banknote conveyance destination, or processing to control operation of each portion. Inside the banknote controller 11 is a storage section configured by, for example, RAM and flash memory. The storage section is stored with various information.

For example, in a pay-in transaction where a customer pays in banknotes, after receiving specific operation input through the operation and display section 6 (FIG. 1), the banknote controller 11 opens the shutter to allow insertion of banknotes into a holding space 12A formed inside a pay-in/pay-out section 12. Using specific sensors, the pay-in/pay-out section 12 detects whether or not one or more banknotes are held inside the holding space 12A, and detects whether or not the maximum holdable quantity of banknotes is being held inside the holding space 12A, and notifies the banknote controller 11 of the detection results.

When banknotes are inserted into the holding space 12A, the pay-in/pay-out section 12 closes the shutter and feeds the banknotes out from the holding space 12A one note at a time, and passes the banknotes to a conveyance F section 13 positioned below the pay-in/pay-out section 12. The conveyance F section 13 includes plural rollers and belts disposed along a conveyance path (illustrated by solid lines in the drawings), includes conveyance guides and the like to guide banknotes, and conveys the banknotes so as to travel along their short edge direction to an identification section 14 positioned to the rear of the conveyance F section 13.

The identification section 14 employs optical devices and magnetic detection devices, for example, to identify the banknotes, for example according to denomination, authenticity, and degree of wear while internally conveying the banknotes toward the rear, and passes the banknotes to a conveyance R section 15 to the rear. The identification section 14 moreover notifies the banknote controller 11 of the classification results (FIG. 1). The banknote controller 11 accordingly decides the conveyance destination of the banknote based on the acquired classification results.

The conveyance R section 15 then, for example, conveys banknotes that the identification section 14 has classified as normal banknotes to a temporary holding section 16 disposed to the rear of the conveyance section R section 15, where they are temporarily held. The conveyance R section 15 also conveys reject banknotes, classified as unsuitable for transaction, to the pay-in/pay-out section 12 to be returned to the customer. The banknote controller 11 then counts the total value of the inserted banknotes and displays this on the operation and display section 6, and prompts the customer to select whether or not to proceed with the pay-in transaction.

When the customer gives an instruction to stop the pay-in transaction, the banknote controller 11 conveys all of the banknotes held in the temporary holding section 16 to the pay-in/pay-out section 12 at the front using the conveyance R section 15, and returns the banknotes to the customer. When the customer gives an instruction to proceed with the pay-in transaction, the banknote controller 11 conveys all of the banknotes held in the temporary holding section 16 to the identification section 14 by the conveyance R section 15 so as to identify the denomination, degree of wear, and the like, and the banknote controller 11 acquires the identification results.

If a banknote has a small degree of wear, the banknote controller 11 conveys the banknote using the conveyance F section 13 and a conveyance M section 17 that is disposed below the conveyance F section 13 to be sorted and stored by denomination in banknote cassettes 18 as a reusable banknote. If a banknote has a large degree of wear, the banknote controller 11 conveys the banknote toward the rear by passing it from the conveyance F section 13 to the conveyance M section 17 disposed below the conveyance F section 13, and then passing the banknote to the conveyance R section 15 disposed above the conveyance M section 17, to be stored in a reject cassette 19 as a banknote that is unsuitable for reuse.

In a pay-out transaction where a customer withdraws banknotes, for example, after receiving specific operation input through the operation and display section 6 (FIG. 1), the banknote controller 11 feeds out banknotes corresponding to the amount to be paid out from the banknote cassettes 18, and conveys the banknotes to the identification section 14 using the conveyance M section 17 and the conveyance F section 13. After identifying the banknotes using the identification section 14, the banknote controller 11 then conveys the banknotes to the pay-in/pay-out section 12 using the conveyance R section 15, collects the banknotes in the holding space 12A, and opens the shutter of the pay-in/pay-out port 5 (FIG. 1) to allow the customer to take the banknotes.

The conveyance F section 13, the conveyance R section 15, and the conveyance M section 17 thus convey banknotes along the conveyance paths formed thereby in pay-in transactions and pay-out transactions.

1-2. Temporary Holding Conveyance Section Configuration

Next, explanation follows regarding configuration of a temporary holding conveyance section 30, this being a portion of the conveyance R section 15 that is positioned directly in front of the temporary holding section 16. As illustrated in side view in FIG. 3, in the temporary holding conveyance section 30, a conveyance space W for conveying banknotes BL is sandwiched from above and below between an upper conveyance section 30U substantially configuring an upper side portion, and a lower conveyance section 30L substantially configuring a lower side portion of the temporary holding conveyance section 30. Respective components of the upper conveyance section 30U and the lower conveyance section 30L are attached to side frames 30F disposed on the left and right outsides thereof.

The lower conveyance section 30L is configured around a plate shaped lower conveyance guide 31 forming a lower face of the conveyance space W. The lower conveyance guide 31 is, for example, formed from a resin material using a manufacturing method such as injection molding. The lower conveyance guide 31 is attached to the side frames 30F through attachment members, not illustrated in the drawings.

Figure 4:
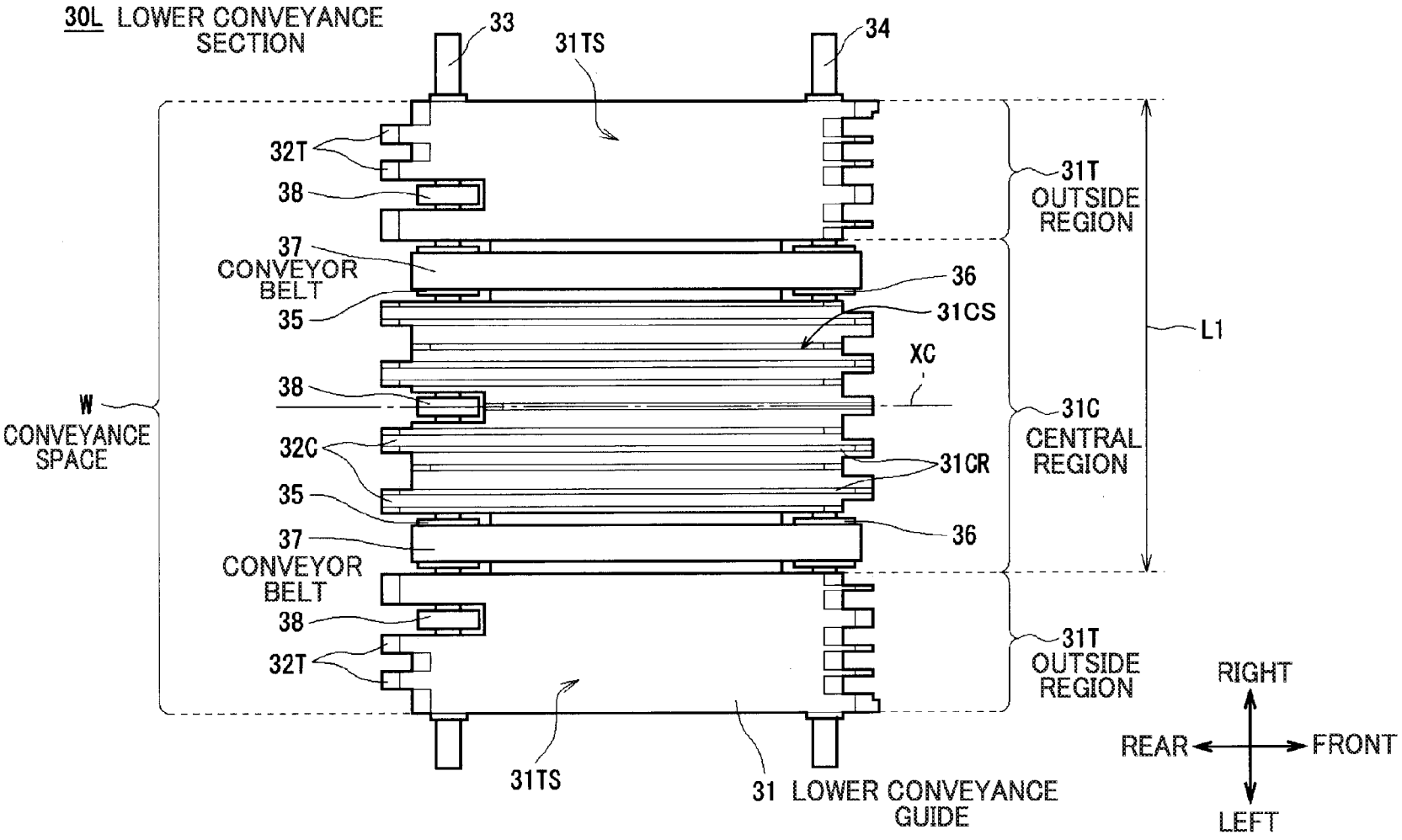
FIG. 4 is a schematic line drawing illustrating a configuration of a lower conveyance section according to the first exemplary embodiment.

As illustrated in plan view in FIG. 4, along the left-right direction, namely a direction orthogonal to the front-rear direction that is the banknote BL conveyance direction, the lower conveyance guide 31 includes a central region 31C, this being a central region including a hypothetical center line XC, and outside regions 31T, these being outside regions on the left and right of the central region 31C.

Figure 3:
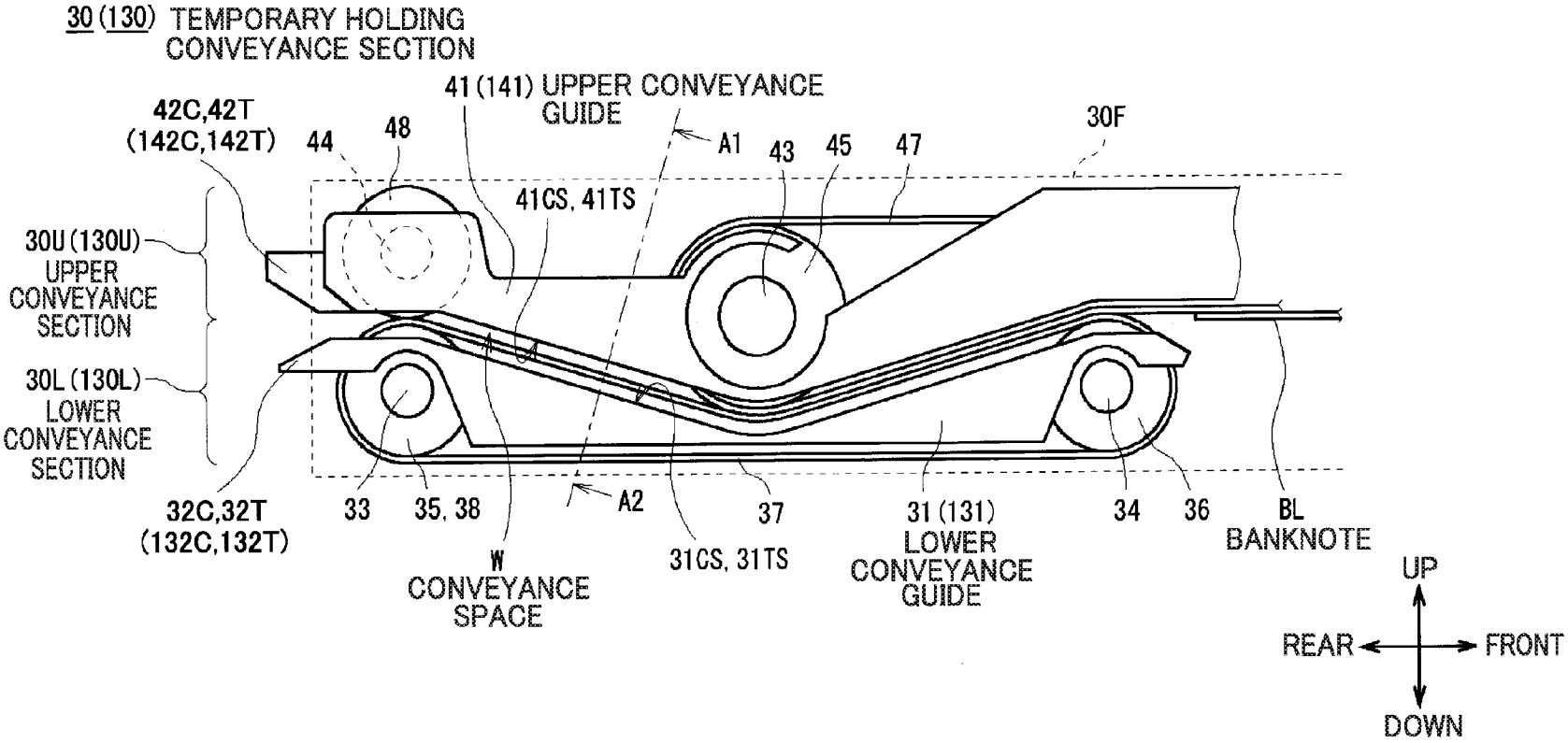
FIG. 3 is a schematic line drawing illustrating a configuration of a temporary holding conveyance section according to a first exemplary embodiment.
Figure 5:
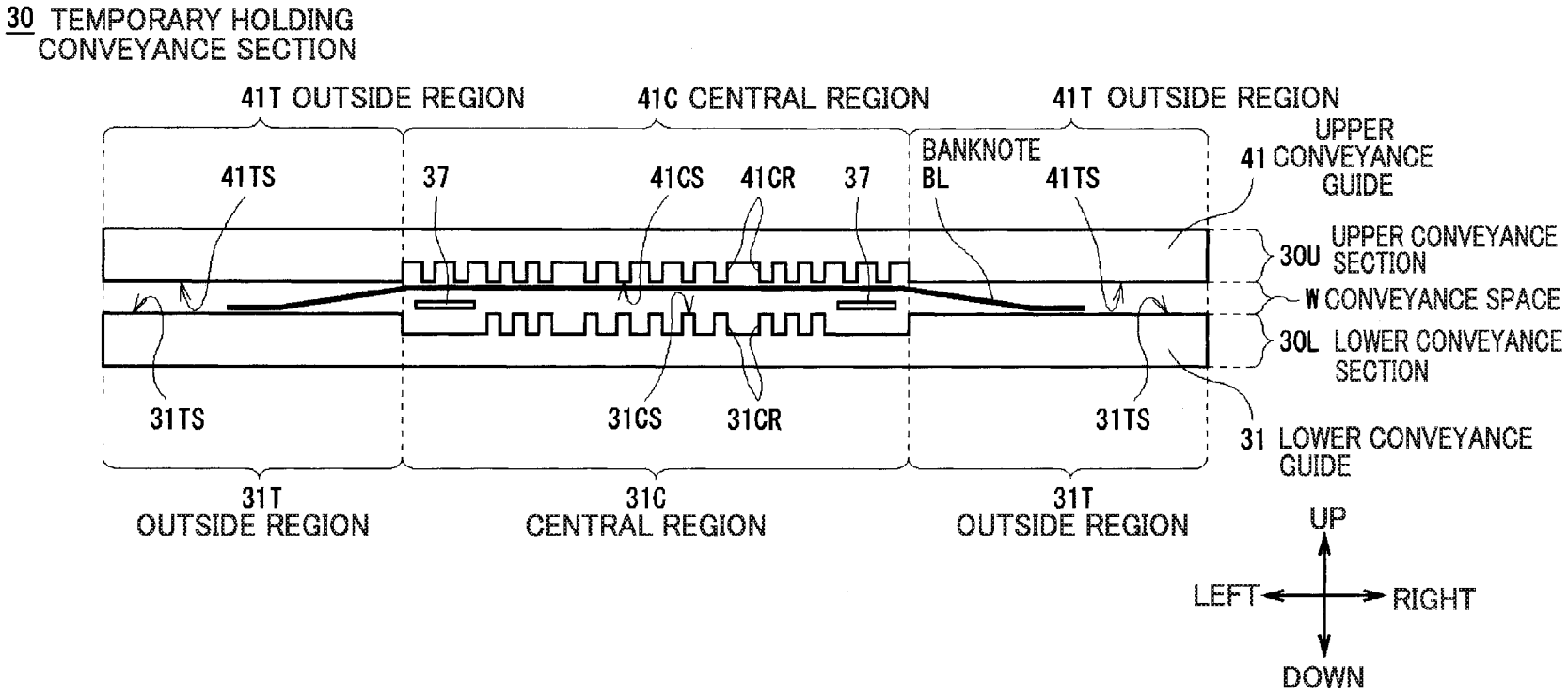
FIG. 5 is a schematic cross-section illustrating a configuration of a temporary holding conveyance section according to the first exemplary embodiment.

As illustrated in FIG. 5, this being a cross-section taken along A1-A2 in FIG. 3, an upper side portion of the central region 31C of the lower conveyance guide 31 is formed with plural grooves running along the front-rear direction, and the portion that remains forms plural ribs 31CR. Namely, the ribs 31CR are formed in plate shapes that are thin in the left-right direction, are long in the overall direction, and project out discretely at specific spacings in the left-right direction. Note that grooves with a width that avoids interference with conveyor belts 37, described later, are formed at the outermost sides of an upper face of the central region 31C, namely in the vicinity of the boundaries with the outside regions 31T.

Accordingly, in the central region 31C, upper faces of the ribs 31CR configure boundary faces to the conveyance space W, thereby reducing the contact surface area with the banknotes BL. In the following explanation, the upper faces of the ribs 31CR are referred to as a guide face 31CS of the central region 31C.

Note that as illustrated in FIG. 3, the upper face of the central region 31C is bent such that the upper face dips downward at a substantially central portion in the front-rear direction. A front half portion and a rear half portion are respectively configured by inclined faces that are lower on the central side.

Plural claw shaped portions 32C project out toward the rear at a rear end portion of the central region 31C of the lower conveyance guide 31 (FIG. 4). The left-right direction length (namely the width) of the claw shaped portions 32C is kept comparatively short, and the claw shaped portions 32C are disposed at specific spacings to each other along the left-right direction. Ribs that are contiguous to the ribs 31CR project out from upper faces of the claw shaped portions 32C, which incline downward at rear end portions thereof (FIG. 3).

In contrast to the central region 31C, the upper faces of the outside regions 31T of the lower conveyance guide 31 (FIG. 4) are not formed with ribs or the like, and configure guide faces 31TS (FIG. 5) that are not formed with large undulations, at least in the left-right direction. Namely, the upper faces of the outside regions 31T are substantially flat, and even supposing they were to be contacted by left-right direction end portions of a banknote, the upper faces of the outside regions 31T are shaped so as to contact portions other than the end faces of the banknotes, without contacting the end faces. Namely, the upper faces of the outside regions 31T have a shape that contacts the paper surface.

The guide faces 31TS are at substantially the same height as the guide face 31CS of the central region 31C. Due to this configuration, the outside regions 31T contact the conveyed banknotes BL, and the guide faces 31TS that are not formed with large undulations in the left-right direction act as boundary faces to the conveyance space W.

At rear end portions of the outside regions 31T of the lower conveyance guide 31 (FIG. 4), plural claw shaped portions 32T project out toward the rear, similarly to in the central region 31C. Similarly to the claw shaped portions 32C, the left-right direction length (namely, the width) of the claw shaped portions 32T is kept comparatively short, and the claw shaped portions 32T are disposed at specific spacings to each other along the left-right direction. Upper faces of the claw shaped portions 32T are formed flat, are contiguous to the flat guide faces 31TS, and incline downward at a rear end portion (FIG. 3).

Note that the claw shaped portions 32C and 32T enmesh with claw shaped portions formed in a similar manner to a conveyance and passing portion of the temporary holding section 16 (FIG. 2) positioned to the rear of the temporary holding conveyance section 30 (detailed explanation follows later).

A drive shaft 33 and an idler shaft 34 are respectively inserted through the vicinity of a rear end and the vicinity of a front end of the lower conveyance section 30L (FIG. 4), so as to penetrate in the left-right direction. The drive shaft 33 and the idler shaft 34 are rotatably attached to the side frames 30F (FIG. 3) so as to be positioned below the conveyance space W at a slight separation thereto.

The drive shaft 33 can be rotated in a clockwise direction in FIG. 3 and in the opposite direction thereto by transmitting drive force using a motor, gears, and the like, not illustrated in the drawings. Two drive pulleys 35 are inserted onto the drive shaft 33.

Each of the drive pulleys 35 is formed in a flattened circular column shape with its central axis along the left-right direction, and the drive pulleys 35 are fixed to the drive shaft 33 so as to be positioned at the outermost left and right sides of the central region 31C. The drive pulleys 35 can accordingly rotate as a unit with the drive shaft 33.

Two idler pulleys 36 are inserted onto the idler shaft 34. Each of the idler pulleys 36 is formed in a flattened circular column shape with its central axis along the left-right direction, similarly to the drive pulleys 35, and the idler pulleys 36 are fixed to the idler shaft 34 so as to be positioned at the outermost left and right sides of the central region 31C. The idler pulleys 36 can accordingly rotate as a unit with the idler shaft 34.

The conveyor belts 37 are entrained between the respective drive pulleys 35 and the respective idler pulleys 36, so as to surround the peripheries thereof. The conveyor belts 37 contain a flexible material, and have a high coefficient of friction at both an inward face and an outward face.

Note that in the lower conveyance section 30L, the radii and positions of the drive pulleys 35 and the idler pulleys 36 are set such that the conveyor belts 37 travel at a position higher than the guide face 31CS of the central region 31C, namely than the upper faces of the ribs 31CR, in the conveyance space W (FIG. 3).

When the drive pulleys 35 rotate as a unit with the drive shaft 33, the conveyor belts 37 travel due to friction acting against the drive pulleys 35, thereby rotating the idler shaft 34 and the idler pulleys 36. When this occurs, if a banknote BL is present in the conveyance space W, the conveyor belts 37 are capable of transmitting drive force to the banknote BL due to the frictional force acting against the banknote BL.

In addition to the drive pulleys 35, three drive rollers 38 are discretely inserted onto the drive shaft 33 (FIG. 4). Similarly to the drive pulleys 35, each of the drive rollers 38 is formed in a flattened circular column shape with the central axis along the left-right direction. One of the drive rollers 38 is disposed in the central region 31C and each of the respective outside regions 31T respectively, and the drive rollers 38 rotate as a unit with the drive shaft 33.

Corresponding holes are formed in the central region 31C and the outside regions 31T respectively, so as to avoid impinging on the drive rollers 38, and the vicinities of upper ends of the drive rollers 38 project out slightly further to the conveyance space W side than the guide face 31CS and 31TS (FIG. 3).

When a banknote BL is being conveyed through the conveyance space W, the drive rollers 38 rotate as a unit with the drive shaft 33, such that conveyance direction drive force acts on the banknote BL. When this occurs, peripheral side faces of the drive rollers 38 contact the paper face of the banknote BL, lifting the banknote BL slightly off the guide face 31CS of the central region 31C and the guide faces 31TS of the outside regions 31T, thereby enabling a reduction in sliding resistance.

Note that boundary lines between the central region 31C and the outside regions 31T in the lower conveyance guide 31 (FIG. 4) are set according to the length direction length of the banknotes BL handled by the banknote pay-in/pay-out device 10. For example, when a shortest banknote length LS is the length direction length of the banknote with the shortest length direction length (referred to below as the shortest banknote) out of the banknotes BL handled by the banknote pay-in/pay-out device 10, a length L1 (FIG. 4) of the left-right direction width of the central region 31C plus one of the outside regions 31T is set shorter than the shortest banknote length LS.

Accordingly, in the temporary holding conveyance section 30, the shortest banknote can intersect the two boundary lines between the central region 31C and the respective outside regions 31T irrespective of whether the shortest banknote is positioned offset to the left or the right of the conveyance space W, enabling the two conveyor belts 37 to contact the shortest banknote reliably. Moreover, in the temporary holding conveyance section 30, the two conveyor belts 37 can obviously contact banknotes BL of other lengths reliably, irrespective of the position of the banknote BL in the left-right direction of the conveyance space W.

From another perspective, the temporary holding conveyance section 30 is capable of contacting a banknote BL at the two conveyor belts 37 in the conveyance space W irrespective of the length direction length of the banknote BL, at which point the length direction (left-right direction) end portions are positioned over the outside regions 31T. Namely, the temporary holding conveyance section 30 does not permit the length direction end portions of a banknote BL being conveyed in the conveyance space W to be positioned over the central region 31C or the conveyor belts 37.

As illustrated from below in FIG. 6, the upper conveyance section 30U has a shape substantially resembling that of the lower conveyance section 30L inverted from top to bottom; however it differs from the lower conveyance section 30L in some points. An upper conveyance guide 41 corresponding to the lower conveyance guide 31 includes a central region 41C and outside regions 41T, respectively corresponding to the central region 31C and the outside regions 31T.

The central region 41C has a shape resembling that of the central region 31C of the lower conveyance guide 31 inverted from top to bottom, and ribs 41CR corresponding to the ribs 31CR project out at specific spacings in the left-right direction. Similarly to the central region 31C, in the central region 41C, lower faces of the ribs 41CR configure boundary faces to the conveyance space W, reducing the contact surface area with the banknotes BL. In the following explanation, the lower faces of the ribs 41CR are referred to as a guide face 41CS of the central region 41C.

As illustrated in FIG. 3, a lower face of the upper conveyance guide 41 is bent so as to project downward at a substantially central portion in the front-rear direction. A front side portion and a rear side portion of the lower face are respectively configured by inclined faces that are lower on the central side.

Figure 6:
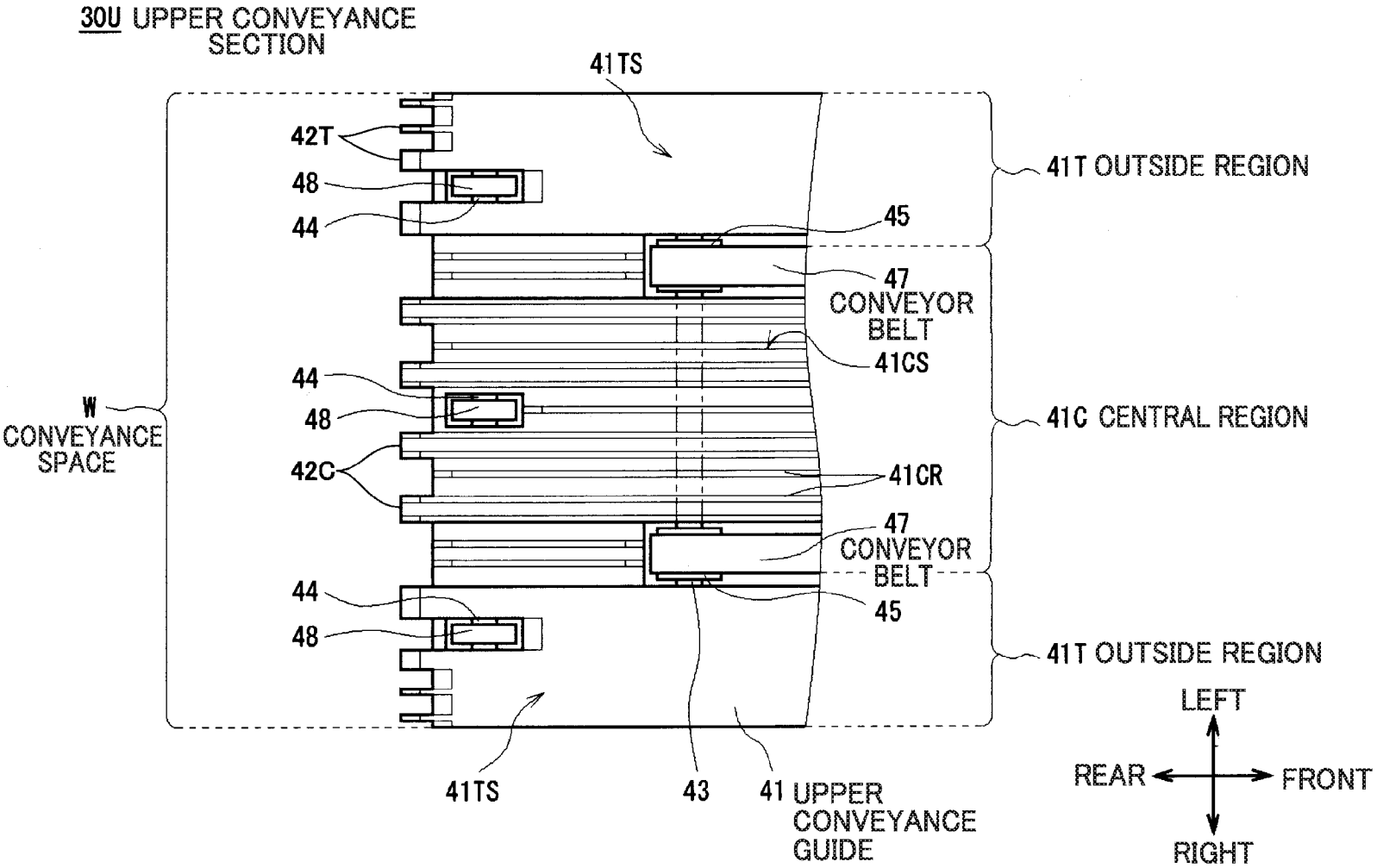
FIG. 6 is a schematic line drawing illustrating a configuration of an upper conveyance section according to the first exemplary embodiment.

Plural claw shaped portions 42C project out toward the rear at a rear end portion of the central region 41C of the upper conveyance guide 41 (FIG. 6). The claw shaped portions 42C are substantially configured with up-down symmetry with the claw shaped portions 32C of the lower conveyance guide 31. The left-right direction length of the claw shaped portions 42C is kept comparatively short, and the claw shaped portions 42C are disposed at specific spacings to each other along the left-right direction. Lower faces of the claw shaped portions 42C are contiguous to the guide face 41CS, and incline upward at a rear end portion (FIG. 3).

As illustrated in FIG. 5, similarly to the outside regions 31T of the lower conveyance guide 31, the outside regions 41T of the upper conveyance guide 41 are not formed with ribs 41CR or the like, forming guide faces 41TS that are not formed with large undulations in the left-right direction. The guide faces 41TS are at substantially the same height as the guide face 41CS configured by the lower faces of the ribs 41CR of the central region 41C. Due to this configuration, the outside regions 41T contact the conveyed banknotes BL similarly to the outside regions 31T, and the guide faces 41TS that are not formed with large undulations in the left-right direction act as boundary faces to the conveyance space W.

At rear end portions of the outside regions 41T of the upper conveyance guide 41 (FIG. 4), plural claw shaped portions 42T project out toward the rear, similarly to in the central region 41C. Similarly to the claw shaped portions 32T of the lower conveyance guide 31, the left-right direction length of the claw shaped portions 42T is kept comparatively short, and the claw shaped portions 42T are disposed at specific spacings to each other along the left-right direction. Lower faces of the claw shaped portions 42T are contiguous to the guide faces 41TS, and incline upward at a rear end portion (FIG. 3).

Note that the claw shaped portions 42C and 42T enmesh with claw shaped portions formed to the conveyance and passing portion of the temporary holding section 16 (FIG. 2), similarly to the claw shaped portions 32C and 32T.

A drive shaft 43 penetrating in the left-right direction is inserted through the vicinity of the front-rear direction center of the upper conveyance section 30U (FIG. 6), namely the lowermost projecting portion (FIG. 3) of the lower face of the upper conveyance section 30U. The drive shaft 43 is attached to the side frames 30F (FIG. 3) so as to be capable of rotating freely at a position above and at a slight separation from the conveyance space W.

Note that similarly to the drive shaft 33 of the lower conveyance section 30L, the drive shaft 43 is capable of rotating in the clockwise direction in FIG. 3 and the opposite direction thereto by transmitting drive force using a motor, gears, and the like, not illustrated in the drawings.

Two drive pulleys 45 are inserted onto the drive shaft 43. Similarly to the drive pulleys 35, each of the drive pulleys 45 is formed in a flattened circular column shape with its central axis along the left-right direction, and the drive pulleys 45 are fixed to the drive shaft 43 so as to be positioned at the outermost left and right sides of the central region 41C. The drive pulleys 45 can accordingly rotate as a unit with the drive shaft 43.

Although not illustrated in the drawings, an idler shaft and idler pulleys, configured similarly to the idler shaft 34 and the idler pulleys 36 of the lower conveyance section 30L, are provided in front of the drive shaft 43 and the drive pulleys 45 in the conveyance R section 15 (FIG. 2). Conveyor belts 47 corresponding to the conveyor belts 37 are respectively entrained between the drive pulleys 45 and the idler pulley, not illustrated, so as to surround the peripheries thereof.

The conveyor belts 47 contain a flexible material, similarly to the conveyor belts 37, and have a high coefficient of friction at both an inward face and an outward face. Accordingly, when the drive pulleys 45 rotate as a unit with the drive shaft 43, the conveyor belts 47 travel around the drive pulleys 45 and the idler pulleys, not illustrated, accompanying this rotation.

Note that in the upper conveyance section 30U, the radii and positions of the drive pulleys 45 are set such that the conveyor belts 47 travel at a position lower than the guide face 41CS of the central region 41C, namely the lower faces of the ribs 41CR, in the conveyance space W, similarly to the conveyor belts 37 (FIG. 3).

When the drive pulleys 45 rotate as a unit with the drive shaft 43, similarly to in the case of the conveyance belt 37, the conveyor belts 47 travel due to friction acting against the drive pulleys 45, thereby rotating the idler shaft and the idler pulleys, not illustrated. When this occurs, if a banknote BL is present in the conveyance space W, the conveyor belts 47 are capable of transmitting drive force to the banknote BL due to the frictional force acting against the banknote BL.

Moreover, short idler shafts 44 resembling the idler shaft 34 cut short in the left-right direction are provided at positions almost directly above the drive shaft 33 in the vicinity of the rear end of the upper conveyance section 30U (FIG. 6) at three discrete locations in the left-right direction, specifically, one each in the central region 41C and at the respective outside regions 41T. The idler shafts 44 are supported by the upper conveyance guide 41 so as to be capable of rotating freely, and so as to be pressed downward by a resilient member, not illustrated in the drawings.

A single idler roller 48 is inserted onto each of the idler shafts 44 so as to correspond to the drive rollers 38. Each of the idler rollers 48 has a flattened circular column shape with its central axis along the left-right direction, similarly to the drive rollers 38.

Corresponding holes are formed as appropriate in the central region 41C and the outside regions 41T so as to avoid impinging on the idler rollers 48, and the vicinities of lower ends of the idler rollers 48 project out slightly further to the conveyance space W side than the guide faces 41CS and 41TS.

The idler rollers 48 accordingly contact the paper face of the banknote BL due to the operation of the resilient member, and rotate due to friction against the banknote BL when a banknote BL is conveyed through the conveyance space W. When this occurs, the idler rollers 48 pull the banknote BL slightly away from the guide face 41CS of the central region 41C and the guide faces 41TS of the outside regions 41T, enabling a reduction in resistance due to friction.

In this manner, in the lower conveyance section 30L and the upper conveyance section 30U of the temporary holding conveyance section 30, the guide faces 31TS and the guide faces 41TS respectively facing the conveyance space W at the outside regions 31T and the outside regions 41T are each configured with shapes that are not formed with large undulations in the left-right direction.

1-3. Operation and Advantageous Effects

In the above configuration, in the temporary holding conveyance section 30 according to the first exemplary embodiment, the guide faces 31TS of the outside regions 31T of the lower conveyance guide 31, and the guide faces 41TS of the outside regions 41T of the upper conveyance guide 41 are each configured with shapes that are not formed with large undulations in the left-right direction.

When conveying a banknote BL through the temporary holding conveyance section 30 in the front-rear direction, this being the conveyance direction, for example, the drive shaft 33 of the lower conveyance section 30L is rotated in the counterclockwise direction in FIG. 3, and the drive shaft 43 of the upper conveyance section 30U is rotated in the clockwise direction.

Accompanying this, the conveyor belts 37 travel in a circuit around the drive pulleys 35 and the idler pulleys 36 in the clockwise direction in FIG. 3. The conveyor belts 47 travel in a circuit around the drive pulleys 45 and the idler pulleys, not illustrated, in the opposite direction thereto.

In the temporary holding conveyance section 30, when a banknote BL is conveyed up toward the front of the conveyance space W in this state, namely from inside the conveyance R section 15 (FIG. 2), the banknote BL is then conveyed toward the rear of the conveyance space W while being gripped between the two sets of conveyor belts 47 and 37. Namely, the banknote BL is then conveyed toward the rear along the guide faces 31CS, 31TS, 41CS, and 41TS.

When this is performed in the temporary holding conveyance section 30, the end portions of the banknote BL in the length direction, namely in the left-right direction orthogonal to the front-rear direction that is the conveyance direction, are positioned in a region of the conveyance space W sandwiched between the outside regions 31T and 41T, and are kept within the conveyance space W.

Accordingly, in the temporary holding conveyance section 30, even if the length direction end portions of the banknote BL that is being conveyed bend downward or upward and contact the lower conveyance guide 31 or the upper conveyance guide 41, the end faces do not rub, since the guide faces 31TS and 41TS of the outside regions 31T and 41T are all formed without large undulations in the left-right direction, and have a substantially flat shape, thereby enabling wear due to friction to be rendered highly unlikely.

On the other hand, in central regions 31C and 41C of the temporary holding conveyance section 30 where there is no concern of wear since the left-right direction end portions of banknotes BL do not make contact, the frictional force that arises if the banknote BL makes contact can be reduced due to the ribs 31CR and 41CR projecting out, similarly to hitherto.

Due to the above configuration, in the temporary holding conveyance section 30, the guide faces 31TS of the outside regions 31T in the lower conveyance guide 31, and the guide faces 41TS of the outside regions 41T in the upper conveyance guide 41 both have profiles that are not formed with large undulations in the left-right direction. Accordingly, even if the length direction end portions of a conveyed banknote BL were to bend upward or downward and contact the lower conveyance guide 31 or the upper conveyance guide 41 in the temporary holding conveyance section 30, the end faces of the banknote BL would not rub against the outside regions 31T and 41T that are formed without large undulations in the left-right direction, thereby enabling wear due to friction to be rendered highly unlikely.

2. Second Exemplary Embodiment

Although an automated teller machine 101 (FIG. 1) according to a second exemplary embodiment differs from the automated teller machine 1 according to the first exemplary embodiment in that a banknote pay-in/pay-out device 110 is included in place of the banknote pay-in/pay-out device 10, other portions thereof are configured similarly.

Although the banknote pay-in/pay-out device 110 (FIG. 2) differs from the banknote pay-in/pay-out device 10 according to the first exemplary embodiment in that a conveyance R section 115 is included in place of the conveyance R section 15, other portions thereof are configured similarly. The conveyance R section 115 includes a temporary holding conveyance section 130 in place of the temporary holding conveyance section 30 of the first exemplary embodiment.

The temporary holding conveyance section 130 (FIG. 3) differs from the temporary holding conveyance section 30 according to the first exemplary embodiment in that an upper conveyance section 130U and a lower conveyance section 130L are included in place of the upper conveyance section 30U and the lower conveyance section 30L.

Figure 7:
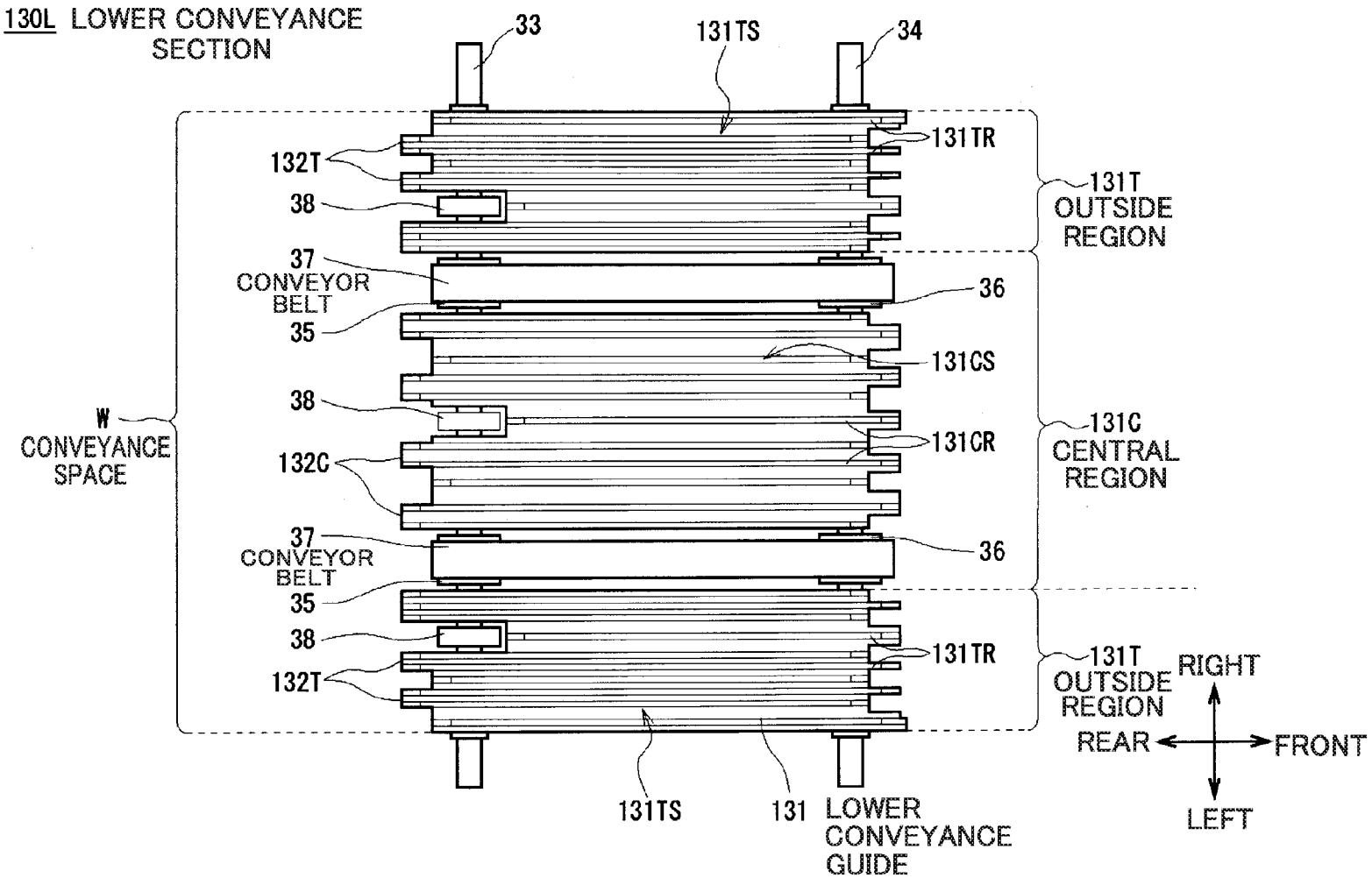
FIG. 7 is a schematic line drawing illustrating a configuration of a lower conveyance section according to a second exemplary embodiment.

As illustrated in FIG. 4 and FIG. 7, although the lower conveyance section 130L differs from the lower conveyance section 30L in that a lower conveyance guide 131 is included in place of the lower conveyance guide 31, other portions thereof are configured similarly. The lower conveyance guide 131 includes a central region 131C and outside regions 131T respectively corresponding to the central region 31C and the outside regions 31T of the lower conveyance guide 31.

In the central region 131C, plural ribs 131CR project out similarly to the ribs 31CR of the central region 31C. Upper faces of the ribs 131CR are referred to below as a guide face 131CS, similarly to in the case of the ribs 31CR.

Figure 8:
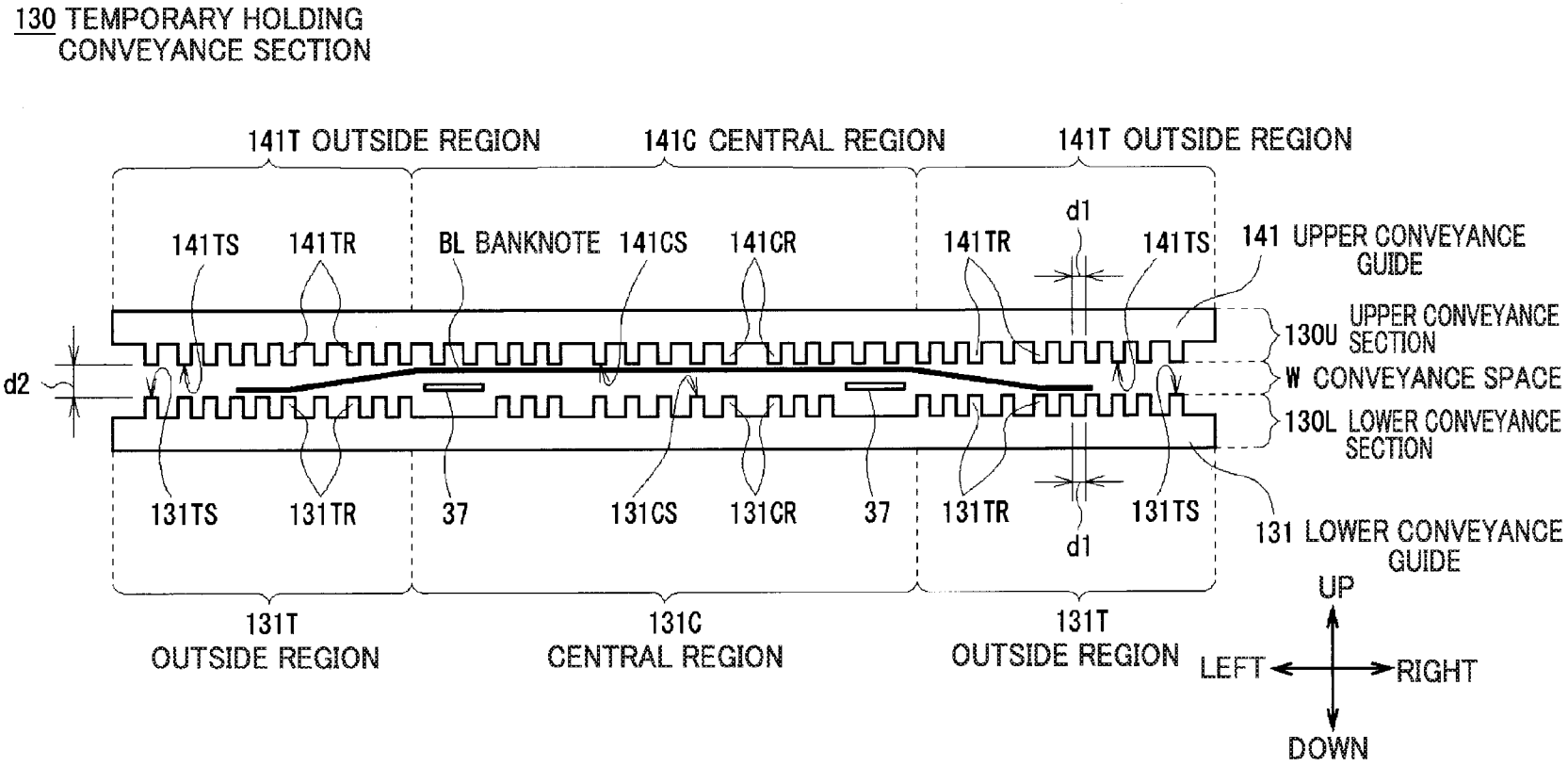
FIG. 8 is a schematic cross-section illustrating a configuration of a temporary holding conveyance section according to the second exemplary embodiment.

As illustrated in FIG. 7, and as illustrated in the cross-section along A1-A2 in FIG. 8, corresponding to FIG. 5, in contrast to the outside regions 31T, plural ribs 131TR project out in the outside regions 131T. Similarly to the ribs 131CR, the ribs 131TR are formed in plate shapes that are thin in the left-right direction, and long in the overall direction, and project out discretely at specific spacings in the left-right direction. In other words, upper faces of the outside regions 131T are formed with plural grooves running along the conveyance direction, and the remaining portions configure the ribs 131TR. The distance d1 between the ribs 131TR in the left-right direction is approximately 2 mm. The upper faces of the ribs 131TR are referred to below as guide faces 131TS, similarly to in the case of the ribs 131CR.

Claw shaped portions 132C and 132T respectively corresponding to the claw shaped portions 32C and 32T of the lower conveyance guide 31 project out respectively from rear ends of the central region 131C and the outside regions 131T of the lower conveyance guide 131. Similarly to the claw shaped portions 32C in the first exemplary embodiment, ribs contiguous to the ribs 131CR and the ribs 131TR respectively project out from the upper faces of the claw shaped portions 132C and 132T, which incline downward at rear end portions thereof (FIG. 3).

Figure 9:
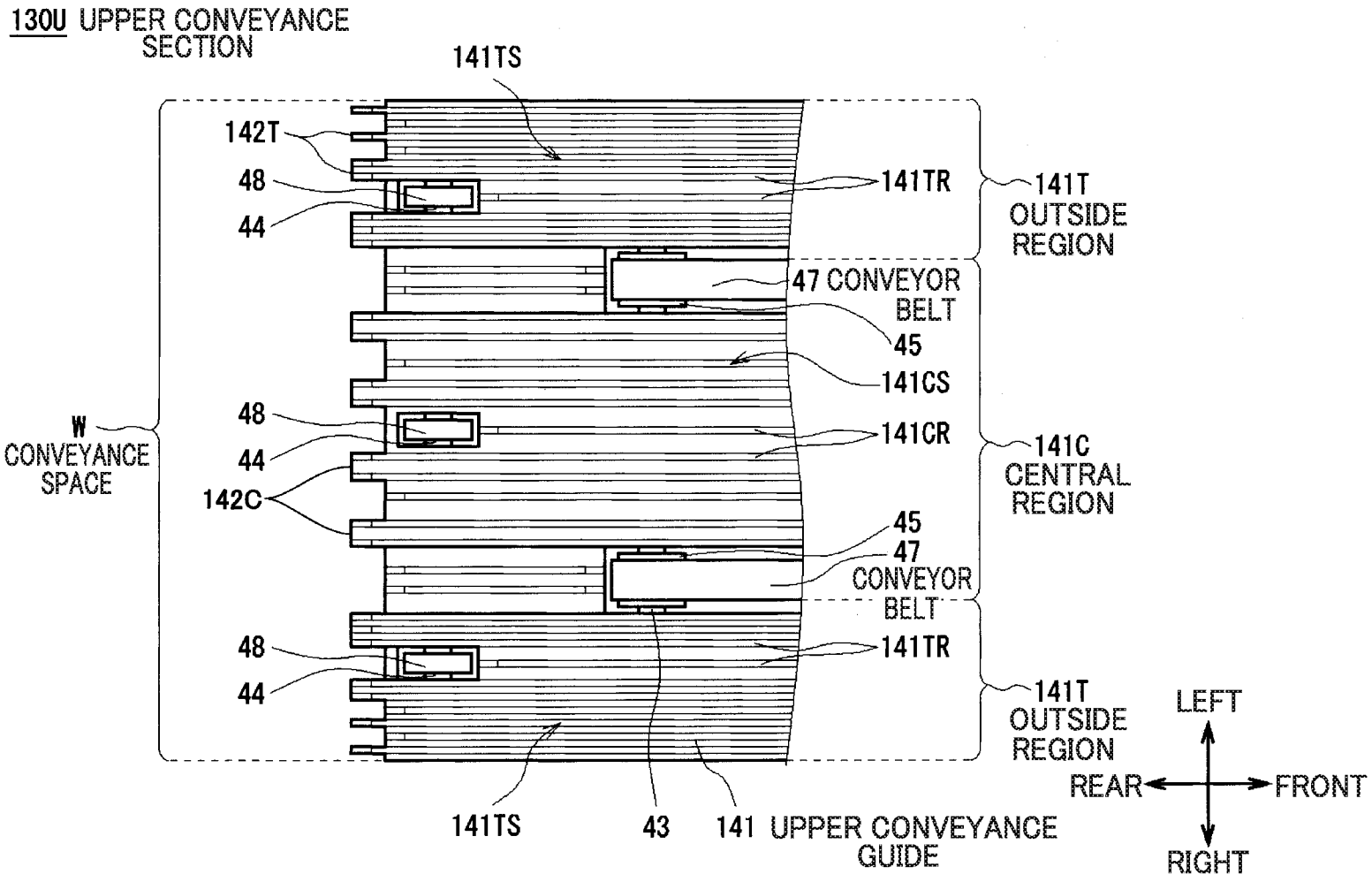
FIG. 9 is a schematic line drawing illustrating a configuration of an upper conveyance section according to the second exemplary embodiment.

As illustrated in FIG. 9 corresponding to FIG. 6, although the upper conveyance section 130U differs from the upper conveyance section 30U according to the first exemplary embodiment in that an upper conveyance guide 141 is included in place of the upper conveyance guide 41, other portions thereof are configured similarly. The upper conveyance guide 141 includes a central region 141C and outside regions 141T respectively corresponding to the central region 41C and the outside regions 41T of the upper conveyance guide 41.

Plural ribs 141CR similar to the ribs 41CR of the central region 41C project out from the central region 141C. The lower faces of the ribs 141CR are referred to below as the guide face 141CS, similarly to in the case of the ribs 41CR.

As illustrated in FIG. 9 and FIG. 8, in contrast to the outside regions 41T, plural ribs 141TR project out from the outside regions 141T. Similarly to the ribs 141CR and the ribs 131TR, the ribs 141TR are formed in plate shapes that are thin in the left-right direction, and long in the overall direction, and project out discretely at specific spacings in the left-right direction. The ribs 141TR are configured such that the distance between adjacent ribs 141TR in the left-right direction is the distance d1, similarly to in the case of the ribs 131TR, namely approximately 2 mm. Lower faces of the ribs 141TR are referred to below as guide faces 141TS, similarly to in the case of the ribs 141CR.

Claw shaped portions 142C and 142T respectively corresponding to the claw shaped portions 42C and 42T of the upper conveyance guide 41 project out respectively from rear ends of the central region 141C and the outside regions 141T in the upper conveyance guide 141. Similarly to the claw shaped portions 42C of the first exemplary embodiment, ribs contiguous to the ribs 141CR and the ribs 141TR project out respectively from upper faces of the claw shaped portions 142C and 142T, which incline downward at rear end portions thereof (FIG. 3).

In the temporary holding conveyance section 130, a distance between the guide faces 131CS and 131TS of the lower conveyance guide 131 and the guide faces 141CS and 141TS of the upper conveyance guide 141, namely a distance d2, this being the up-down direction length of the conveyance space W, is 6 mm.

In the above configuration, in the temporary holding conveyance section 130 according to the second exemplary embodiment, the ribs 131TR and 141TR respectively project out at the guide faces 131TS of the outside regions 131T in the lower conveyance guide 131, and at the guide faces 141TS of the outside regions 141T in the upper conveyance guide 141.

Accordingly, the temporary holding conveyance section 130 enables a reduction in the contact surface area with the banknotes BL, similarly to the central regions 131C and 141C, thereby enabling a reduction in frictional force arising on contact with the banknotes BL. Accordingly, the temporary holding conveyance section 130 enables a reduction in the frictional force that acts on the conveyed banknotes BL, thereby enabling smoother conveyance of banknotes BL than the temporary holding conveyance section 30 according to the first exemplary embodiment.

Figure 10A:
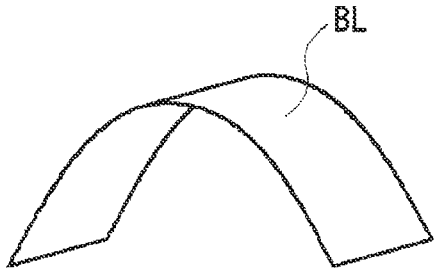
FIG. 10A is a schematic line drawing illustrating deformation of a banknote.
Figure 10B:
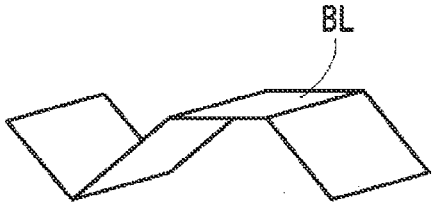
FIG. 10B is a schematic line drawing illustrating deformation of a banknote.

In the temporary holding conveyance section 130, the up-down direction length of the conveyance space W, namely the distance d2 between the guide faces 131CS and 131TS of the lower conveyance guide 131 and the guide faces 141CS and 141TS of the upper conveyance guide 141, is comparatively narrow, at 6 mm. The temporary holding conveyance section 130 accordingly enables a banknote BL that has curled up or creased, as illustrated in FIG. 10A and FIG. 10B, to be straightened out so as to be substantially flat in the left-right direction.

Figure 11:
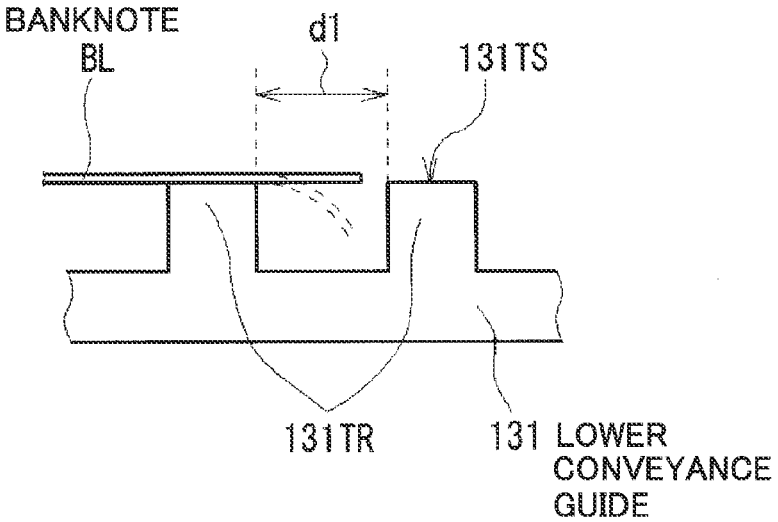
FIG. 11 is a schematic cross-section illustrating a relationship between ribs formed to an outside region of a lower conveyance guide and a banknote.

In the temporary holding conveyance section 130, the distance d1 that is the left-right direction spacing between the ribs 131TR and 141TR is set very narrow, at approximately 2 mm. Accordingly, as illustrated in FIG. 11 illustrating an enlarged portion of FIG. 8, the temporary holding conveyance section 130 enables a left-right direction end portion of a banknote BL to be rendered highly unlikely to droop under the force of gravity or the like and enter a gap between the ribs 131TR.

Namely, since the distance d2 that is the height of the conveyance space W is approximately 6 mm, and the distance d1 is approximately 2 mm, from the perspectives of rigidity and the like, the temporary holding conveyance section 130 can dramatically reduce the risk of the left-right direction end portions of a banknote BL drooping into a gap between the ribs 131TR, namely the end portions can be kept within the conveyance space W, particularly in cases in which the banknotes BL are polymer banknotes.

In other words, a distance of approximately 2 mm is selected as the distance d1 in consideration of the height of the conveyance space W and the rigidity and the like of the banknotes BL that are polymer banknotes, and also taking into account the characteristics of the resin material of the lower conveyance guide 131, limitations of the molding method, such as injection molding, and the like in the lower conveyance guide 131, such that the left-right direction end portions of the banknotes BL do not enter the gaps between the ribs 131TR.

Accordingly, the temporary holding conveyance section 130 enables the risk of wear due to contact with side faces of the ribs 131TR and 141TR projecting out from the outside regions 131T and 141T at left and right end faces of the banknotes BL, including polymer banknotes, conveyed in the front-rear direction, this being the conveyance direction, to be kept very low, and enables continuous stable conveyance.

In other respects, the temporary holding conveyance section 130 is capable of similar operation and advantageous effects to those of the temporary holding conveyance section 30 according to the first exemplary embodiment.

According to the above configuration, in the temporary holding conveyance section 130 according to the second exemplary embodiment, the guide faces 131TS of the outside regions 131T in the lower conveyance guide 131, and the guide faces 141TS of the outside regions 141T of the upper conveyance guide 141 are respectively provided with the ribs 131TR and 141TR projecting out at every distance d1. Accordingly, the temporary holding conveyance section 130 is capable of reducing the contact surface area with the guide faces 131TS and 141TS, while suppressing the likelihood of the left-right direction end faces of the banknotes BL contacting side faces of the ribs 131TR and the ribs 141TR in the outside regions 131T and 141T, thereby enabling a reduction in frictional force arising on contact with a banknote BL, and enabling stable and smooth conveyance of the banknotes BL.

3. Third Exemplary Embodiment

Although an automated teller machine 201 (FIG. 1) according to a third exemplary embodiment differs from the automated teller machine 1 according to the first exemplary embodiment in that a banknote pay-in/pay-out device 210 is included in place of the banknote pay-in/pay-out device 10, other portions thereof are configured similarly.

Although the banknote pay-in/pay-out device 210 (FIG. 2) differs from the banknote pay-in/pay-out device 10 according to the first exemplary embodiment in that a passing conveyance section 70 is provided to the temporary holding section 16, other portions thereof, including the conveyance R section 15, are configured similarly. Namely, the conveyance R section 15 includes the temporary holding conveyance section 30, similarly to the first exemplary embodiment.

Figure 12:
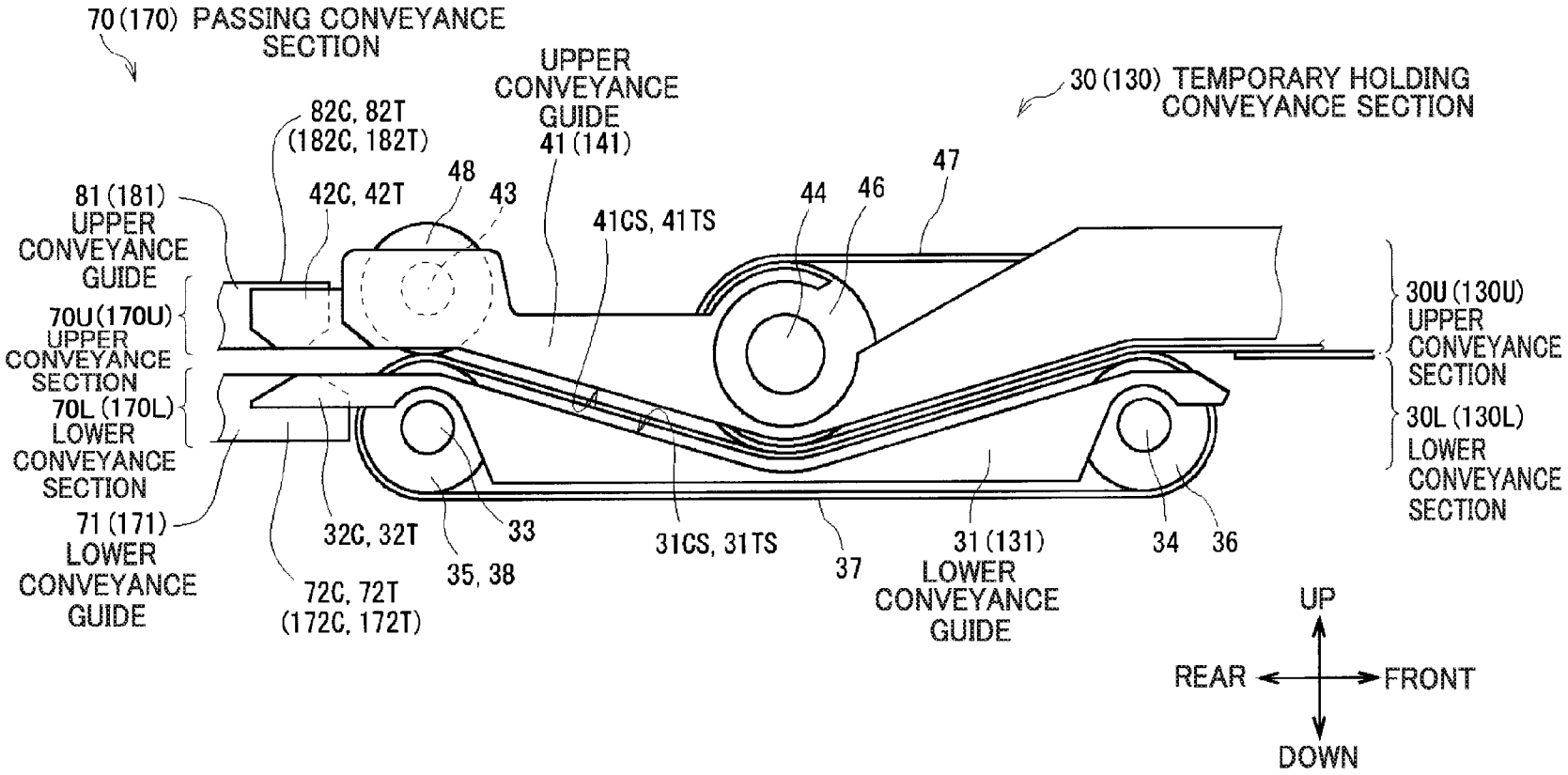
FIG. 12 is a schematic line drawing illustrating a configuration of a temporary holding conveyance section according to a third exemplary embodiment.

As illustrated in FIG. 12 corresponding to FIG. 3, the passing conveyance section 70 includes an upper conveyance section 70U and a lower conveyance section 70L, respectively corresponding to the upper conveyance section 30U and the lower conveyance section 30L of the temporary holding conveyance section 30.

The lower conveyance section 70L has a configuration corresponding to that of the lower conveyance section 30L, and is configured around a plate shaped lower conveyance guide 71 forming a lower face of the conveyance space W. As illustrated in plan view in FIG. 13 corresponding to FIG. 4, the lower conveyance guide 71 is divided into three regions in the left-right direction, similarly to the lower conveyance guide 31, and includes a central region 71C and two outside regions 71T, respectively corresponding to the central region 31C and the two outside regions 31T on the temporary holding conveyance section 30 side.

Similarly to the central region 31C of the lower conveyance guide 31, plate shaped ribs 71CR that are thin in the left-right direction and long in the front-rear direction project out discretely from an upper face of the central region 71C at specific spacings in the left-right direction. Plural claw shaped portions 72C project out toward the front at a front end portion of the central region 71C. The positions, left-right direction length, and the like of the claw shaped portions 72C are optimized for enmeshing with the claw shaped portions 32C on the temporary holding conveyance section 30 side.

Similarly to the outside regions 31T of the lower conveyance guide 31, ribs and the like do not project out from the upper faces of the outside regions 71T, and the upper faces have profiles that are not formed with large undulations in the left-right direction. Moreover, plural claw shaped portions 72T project out toward the front from front end portions of the outside regions 71T. The positions, left-right direction length, and the like of the claw shaped portions 72T are optimized for enmeshing with the claw shaped portions 32T on the temporary holding conveyance section 30 side.

Accordingly, what appears as a continuous guide face can be formed at the lower face side of the conveyance space W between the lower conveyance guide 71 of the passing conveyance section 70 and the lower conveyance guide 31 of the temporary holding conveyance section 30, without forming breaks or steps, by enmeshing the claw shaped portions 32C and 32T with the claw shaped portions 72C and 72T.

The claw shaped portions 72C and 72T of the lower conveyance guide 71 are designed such that a distance d3 to the respective claw shaped portions 32C and 32T of the lower conveyance guide 31 adjacent in the left-right direction is approximately 2 mm, similarly to the spacing d1 between the ribs 131TR and 141TR in the second exemplary embodiment.

The upper conveyance section 70U has a configuration corresponding to the upper conveyance section 30U, and is configured around a plate shaped upper conveyance guide 81 forming an upper face of the conveyance space W. As illustrated from underneath in FIG. 14 corresponding to FIG. 6, the upper conveyance guide 81 is divided into three regions in the left-right direction, similarly to the upper conveyance guide 41, and includes a central region 81C and two outside regions 81T, respectively corresponding to the central region 41C and the two outside regions 41T on the temporary holding conveyance section 30 side.

Similarly to the central region 41C of the upper conveyance guide 41, plate shaped ribs 81CR that are thin in the left-right direction and long in the front-rear direction project out discretely from a lower face of the central region 81C at specific spacings in the left-right direction. Plural claw shaped portions 82C project out toward the front from a front end portion of the central region 81C. The positions, left-right direction length, and the like of the claw shaped portions 82C are optimized for enmeshing with the claw shaped portions 42C on the temporary holding conveyance section 30 side.

Similarly to the outside regions 41T of the upper conveyance guide 41, ribs and the like do not project out from the lower faces of the outside regions 81T, and the lower faces have profiles that are not formed with large undulations in the left-right direction. Plural claw shaped portions 82T project out toward the front at front end portions of the outside regions 81T. The positions, left-right direction length, and the like of the claw shaped portions 82T are optimized for enmeshing with the claw shaped portions 42T on the temporary holding conveyance section 30 side.

Accordingly, similarly to with the lower conveyance guide 71, what appears as a continuous guide face can be formed at the upper face side of the conveyance space W between the upper conveyance guide 81 of the passing conveyance section 70 and the upper conveyance guide 41 of the temporary holding conveyance section 30, without forming breaks or steps, by enmeshing the claw shaped portions 42C and 42T with the claw shaped portions 82C and 82T.

The claw shaped portions 82C and 82T of the upper conveyance guide 81 are designed such that a distance d3 to the respective claw shaped portions 42C and 42T of the upper conveyance guide 41 adjacent in the left-right direction is approximately 2 mm, similarly to the claw shaped portions 72C and 72T of the lower conveyance guide 71.

Note that by enmeshing the claw shaped portions projecting out from the end portions of the respective conveyance guides, the temporary holding conveyance section 30 and the passing conveyance section 70 achieve both smooth passing of the banknotes BL passed through the conveyance space W from front to rear when carrying out various transaction processing, and simple disconnection and reconnection of the respective sections during maintenance operations and the like.

Figure 13:
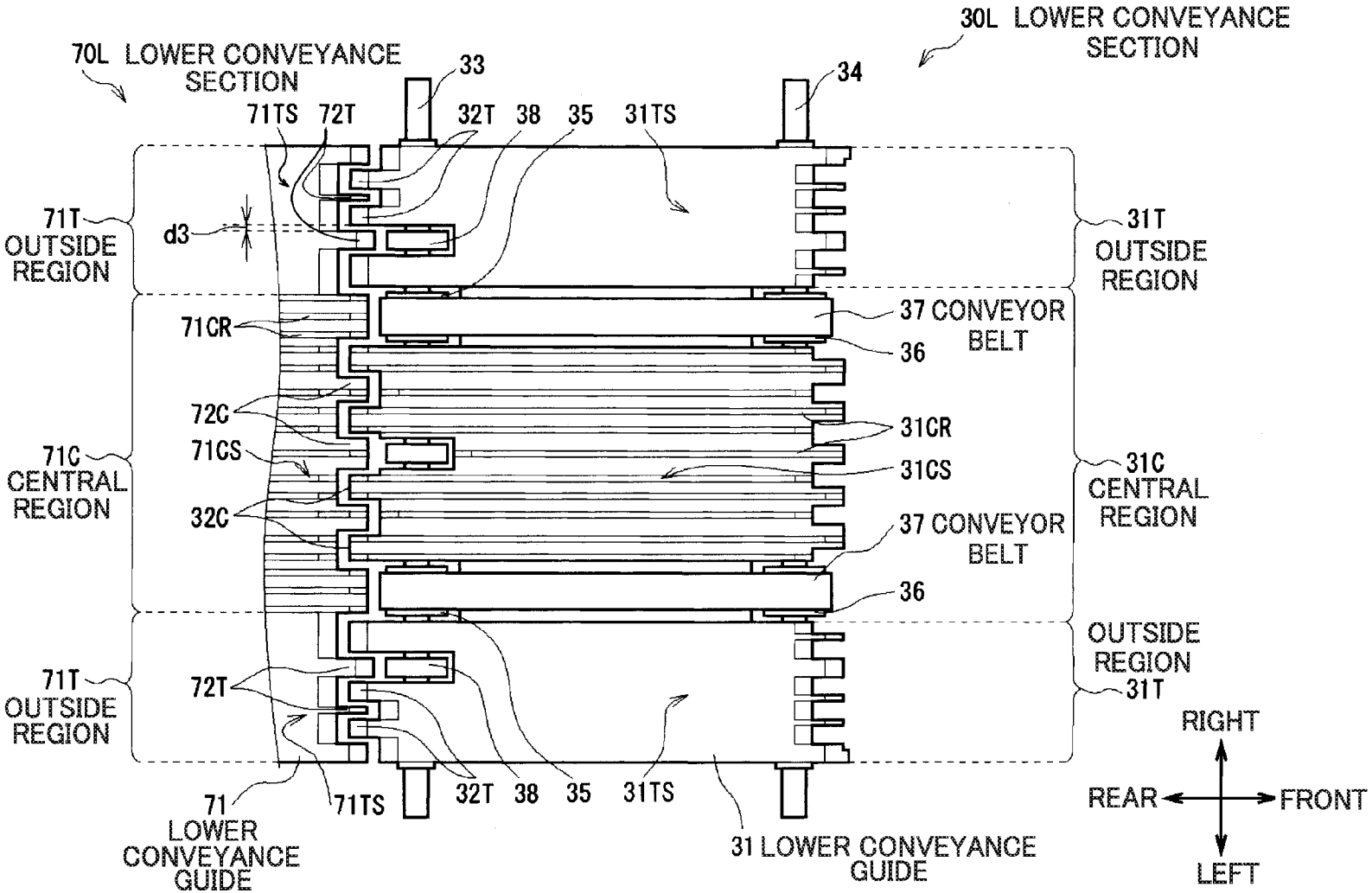
FIG. 13 is a schematic line drawing illustrating a configuration of a lower conveyance section according to the third exemplary embodiment.
Figure 14:
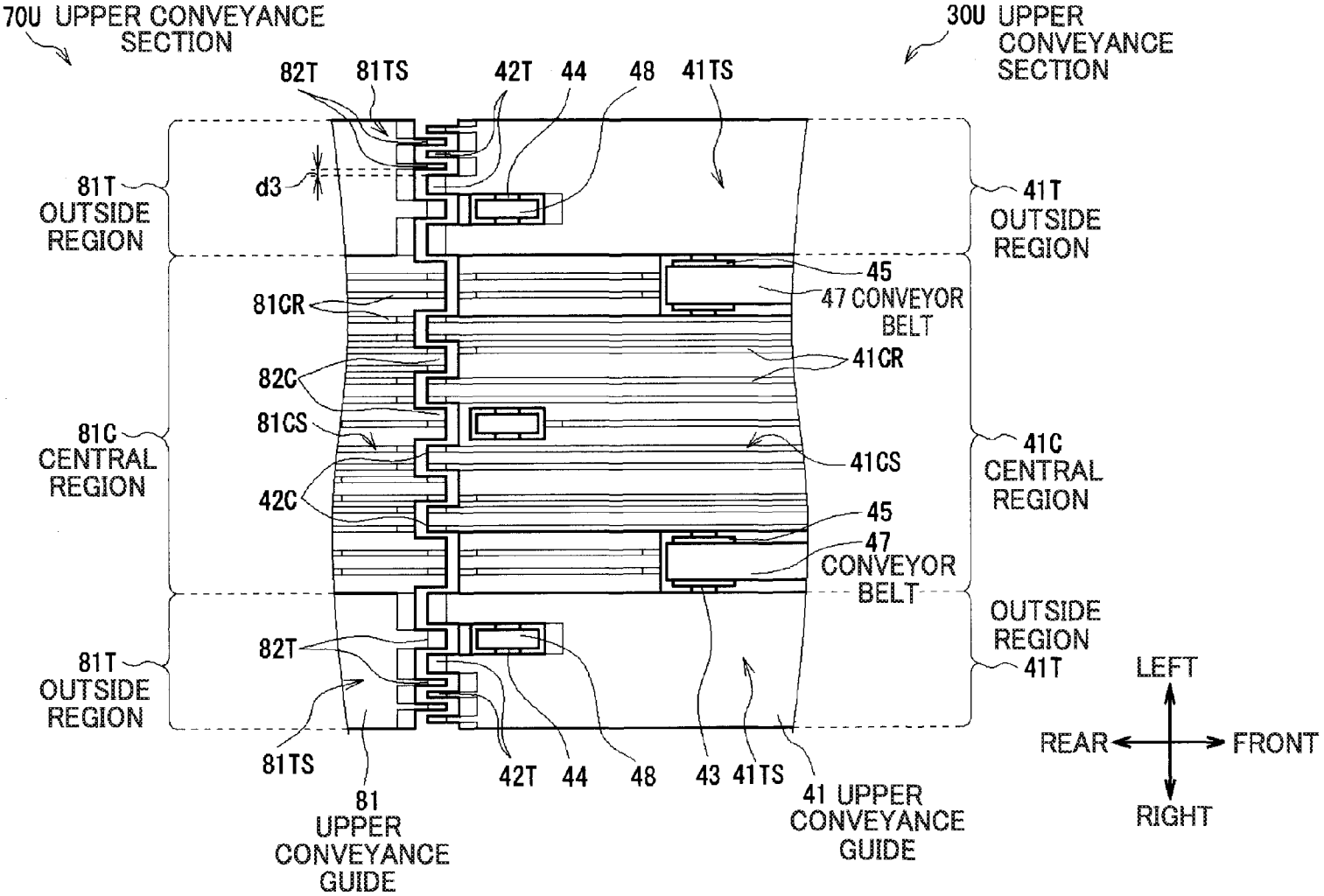
FIG. 14 is a schematic line drawing illustrating a configuration of an upper conveyance section according to the third exemplary embodiment.

In the above configuration, in the banknote pay-in/pay-out device 210 according to the third exemplary embodiment, the lower conveyance guide 71 and the upper conveyance guide 81 that guide banknotes BL in the passing conveyance section 70 of the temporary holding section 16 (FIG. 2) are divided into the central regions 71C and 81C and the outside regions 71T and 81T, similarly to in the lower conveyance guide 31 and the upper conveyance guide 41 of the temporary holding conveyance section 30 (FIG. 13, FIG. 14).

Similarly to in the central regions 31C and 41C, ribs 71CR and 81CR running along the conveyance direction project out from an upper face of the central region 71C and a lower face of the central region 81C. However, the upper faces of the outside regions 71T and the lower faces of the outside regions 81T are not provided with ribs and are configured with profiles not formed with large undulations in the left-right direction, similarly to the outside regions 31T and 41T.

Similarly to the temporary holding conveyance section 30, during banknote BL conveyance by the passing conveyance section 70, the left-right direction end faces are positioned in regions sandwiched between the outside regions 71T and 81T. Accordingly, in the passing conveyance section 70, similarly to in the temporary holding conveyance section 30, even if the length direction end portions of the banknote BL that is being conveyed bend downward or upward and contact the lower conveyance guide 71 or the upper conveyance guide 81, wear due to friction can be rendered highly unlikely since the guide faces 31TS and 41TS of the outside regions 71T and 81T are all formed without large undulations in the left-right direction.

On the other hand, similarly to in the temporary holding conveyance section 30, in the central regions 71C and 81C of the passing conveyance section 70 where there is no concern of wear since the left-right direction end portions of banknotes BL are not positioned there, the frictional force that arises if the banknote BL makes contact can be reduced due to the ribs 71CR and 81CR projecting out.

The distance d3 between the claw shaped portions 72C and 72T provided to the front end of the lower conveyance guide 71, and the claw shaped portions 32C and 32T of the lower conveyance guide 31 adjacent in the left-right direction is set at approximately 2 mm (FIG. 13). Moreover, the distance d3 between the claw shaped portions 82C and 82T provided to the front end of the upper conveyance guide 81 and the claw shaped portions 82C and 82T of the upper conveyance guide 41 adjacent in the left-right direction is also set at approximately 2 mm (FIG. 14).

Accordingly, similarly to the ribs 131TR in the second exemplary embodiment, in the portion connected to the temporary holding conveyance section 30, the passing conveyance section 70 enables a left-right direction end portion of a banknote BL to be rendered highly unlikely to droop under the force of gravity and enter a gap between the claw shaped portions 72C and 72T and the claw shaped portions 32C and 32T, or a gap between the claw shaped portions 82C and 82T and the claw shaped portions 42C and 42T, or the like. As a result, the passing conveyance section 70 enables wear of the claw shaped portions 32C and 32T etc., and of the claw shaped portions 72C and 72T etc. to be suppressed, enabling continuous stable passing of banknotes BL.

The temporary holding conveyance section 30 is capable of similar operation and advantageous effects to the first exemplary embodiment in other respects.

According to the above configuration, in the lower conveyance guide 71 and the upper conveyance guide 81 of the passing conveyance section 70 of the banknote pay-in/pay-out device 210 according to the third exemplary embodiment, similarly to with the lower conveyance guide 31 and the upper conveyance guide 41 of the temporary holding conveyance section 30, the ribs 71CR and 81CR running along the conveyance direction project out from the upper face of the central region 71C and the lower face of the central region 81C, and the upper faces of the outside regions 71T and the lower faces of the outside regions 81T are not provided with ribs and have profiles that are not formed with large undulations in the left-right direction. Accordingly, in both the temporary holding conveyance section 30 and the passing conveyance section 70 of the banknote pay-in/pay-out device 210, even if the length direction end portions of a banknote BL being conveyed bend downward or upward and contact the lower conveyance guide 31 or 71, or the upper conveyance guide 41 or 81, the end faces of the banknote do not rub, thereby enabling wear due to friction to be rendered highly unlikely.

4. Fourth Exemplary Embodiment

Although an automated teller machine 301 (FIG. 1) according to a fourth exemplary embodiment differs from the automated teller machine 101 according to the second exemplary embodiment in that a banknote pay-in/pay-out device 310 is included in place of the banknote pay-in/pay-out device 110, other portions thereof are configured similarly.

Although the banknote pay-in/pay-out device 310 (FIG. 2) differs from the banknote pay-in/pay-out device 110 according to the second exemplary embodiment in that a passing conveyance section 170 is provided to the temporary holding section 16, other portions thereof, including the conveyance R section 115, are configured similarly. Namely, the conveyance R section 115 includes the temporary holding conveyance section 130 (FIG. 7 to FIG. 9), similarly to in the second exemplary embodiment.

As illustrated in FIG. 12, the passing conveyance section 170 includes an upper conveyance section 170U and a lower conveyance section 170L, respectively corresponding to the upper conveyance section 130U and the lower conveyance section 130L of the temporary holding conveyance section 130.

The lower conveyance section 170L has a configuration corresponding to that of the lower conveyance section 130L, and is configured around a plate shaped lower conveyance guide 171 forming a lower face of the conveyance space W. As illustrated in plan view in FIG. 15 corresponding to FIG. 7, the lower conveyance guide 171 is divided into three regions in the left-right direction, similarly to the lower conveyance guide 131 and the lower conveyance guide 71 (FIG. 13), and includes a central region 171C and two outside regions 171T respectively corresponding to the central region 131C and the two outside regions 131T on the temporary holding conveyance section 130 side.

Similarly to the central region 131C of the lower conveyance guide 131 and the central region 71C of the lower conveyance guide 71 (FIG. 13), plate shaped ribs 171CR that are thin in the left-right direction and long in the front-rear direction project out discretely from an upper face of the central region 171C at specific spacings in the left-right direction. Plural claw shaped portions 172C project out toward the front at a front end portion of the central region 171C. The positions, left-right direction length, and the like of the claw shaped portions 172C are optimized for enmeshing with the claw shaped portions 132C on the temporary holding conveyance section 130 side.

Similarly to in the outside regions 131T of the lower conveyance guide 131, plate shaped ribs 171TR that are thin in the left-right direction and long in the front-rear direction project out discretely from upper faces of the outside regions 171T at specific spacings in the left-right direction. Plural claw shaped portions 172T project out toward the front at front end portions of the outside regions 171T. The positions, left-right direction length, and the like of the claw shaped portions 172T are optimized for enmeshing with the claw shaped portions 132T on the temporary holding conveyance section 130 side.

Accordingly, similarly to with the lower conveyance guide 71 (FIG. 13), what appears as a continuous guide face can be formed at the lower face side of the conveyance space W (FIG. 12) between the lower conveyance guide 171 of the passing conveyance section 170 and the lower conveyance guide 131 of the temporary holding conveyance section 130, without forming breaks or steps, by enmeshing the claw shaped portions 132C and 132T with the claw shaped portions 172C and 172T.

Similarly to in the third exemplary embodiment, the claw shaped portions 172C and 172T of the lower conveyance guide 171 are designed such that a distance d3 to the respective claw shaped portions 132C and 132T of the lower conveyance guide 131 adjacent in the left-right direction is approximately 2 mm, similarly to the spacing d1 between the ribs 131TR and 141TR in the second exemplary embodiment.

The upper conveyance section 170U has a configuration corresponding to that of the upper conveyance section 130U, and is configured around a plate shaped upper conveyance guide 181 forming an upper face of the conveyance space W (FIG. 12). As illustrated from underneath in FIG. 16 corresponding to FIG. 9, the upper conveyance guide 181 is divided into three regions in the left-right direction, similarly to the upper conveyance guide 141, and includes a central region 181C and two outside regions 181T, respectively corresponding to the central region 141C and the two outside regions 141T on the temporary holding conveyance section 130 side.

Similarly to the central region 141C of the upper conveyance guide 141, plate shaped ribs 181CR that are thin in the left-right direction, and long in the front-rear direction project out discretely from a lower face of the central region 181C at specific spacings in the left-right direction. Plural claw shaped portions 182C project out toward the front from a front end portion of the central region 181C. The positions, left-right direction length, and the like of the claw shaped portions 182C are optimized for enmeshing with the claw shaped portions 142C on the temporary holding conveyance section 130 side.

Similarly to the outside regions 141T of the upper conveyance guide 141, plate shaped ribs 181TR that are thin in the left-right direction, and long in the front-rear direction project out discretely from upper faces of the outside regions 181T at specific spacings in the left-right direction. Plural claw shaped portions 182T project out toward the front from front end portions of the outside regions 181T. The positions, left-right direction length, and the like of the claw shaped portions 182T are optimized for enmeshing with the claw shaped portions 142T on the temporary holding conveyance section 130 side.

Accordingly, similarly to with the lower conveyance guide 171, what appears as a continuous guide face can be formed at the upper face side of the conveyance space W (FIG. 12) between the upper conveyance guide 181 of the passing conveyance section 170 and the upper conveyance guide 141 of the temporary holding conveyance section 130, without forming breaks or steps, by enmeshing the claw shaped portions 142C and 142T with the claw shaped portions 182C and 182T.

The claw shaped portions 182C and 182T of the upper conveyance guide 181 are designed such that a distance d3 to the respective claw shaped portions 142C and 142T of the upper conveyance guide 141 adjacent in the left-right direction is approximately 2 mm, similarly to the claw shaped portions 172C and 172T of the lower conveyance guide 171.

Figure 15:
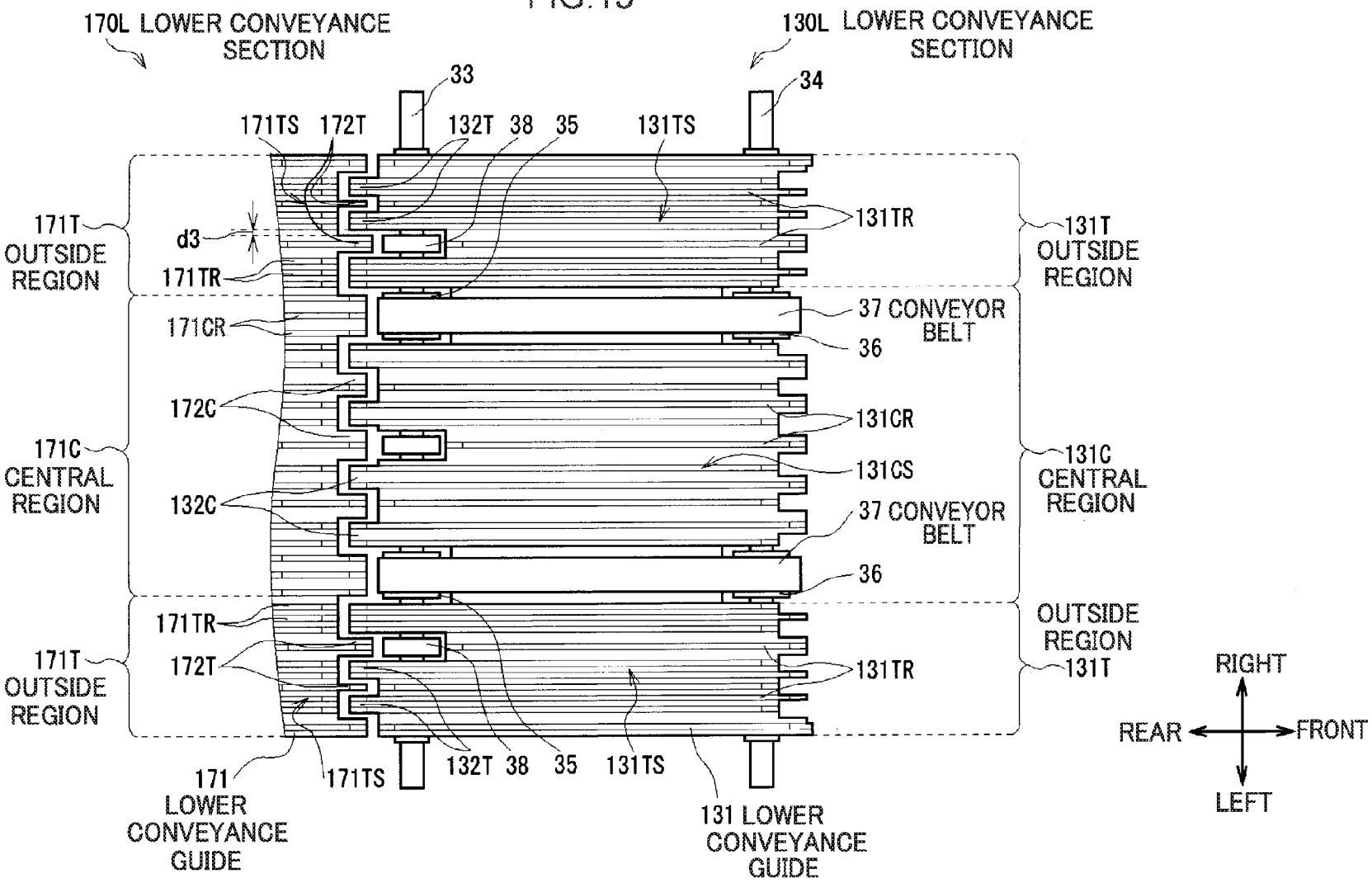
FIG. 15 is a schematic line drawing illustrating a configuration of a lower conveyance section according to a fourth exemplary embodiment.
Figure 16:
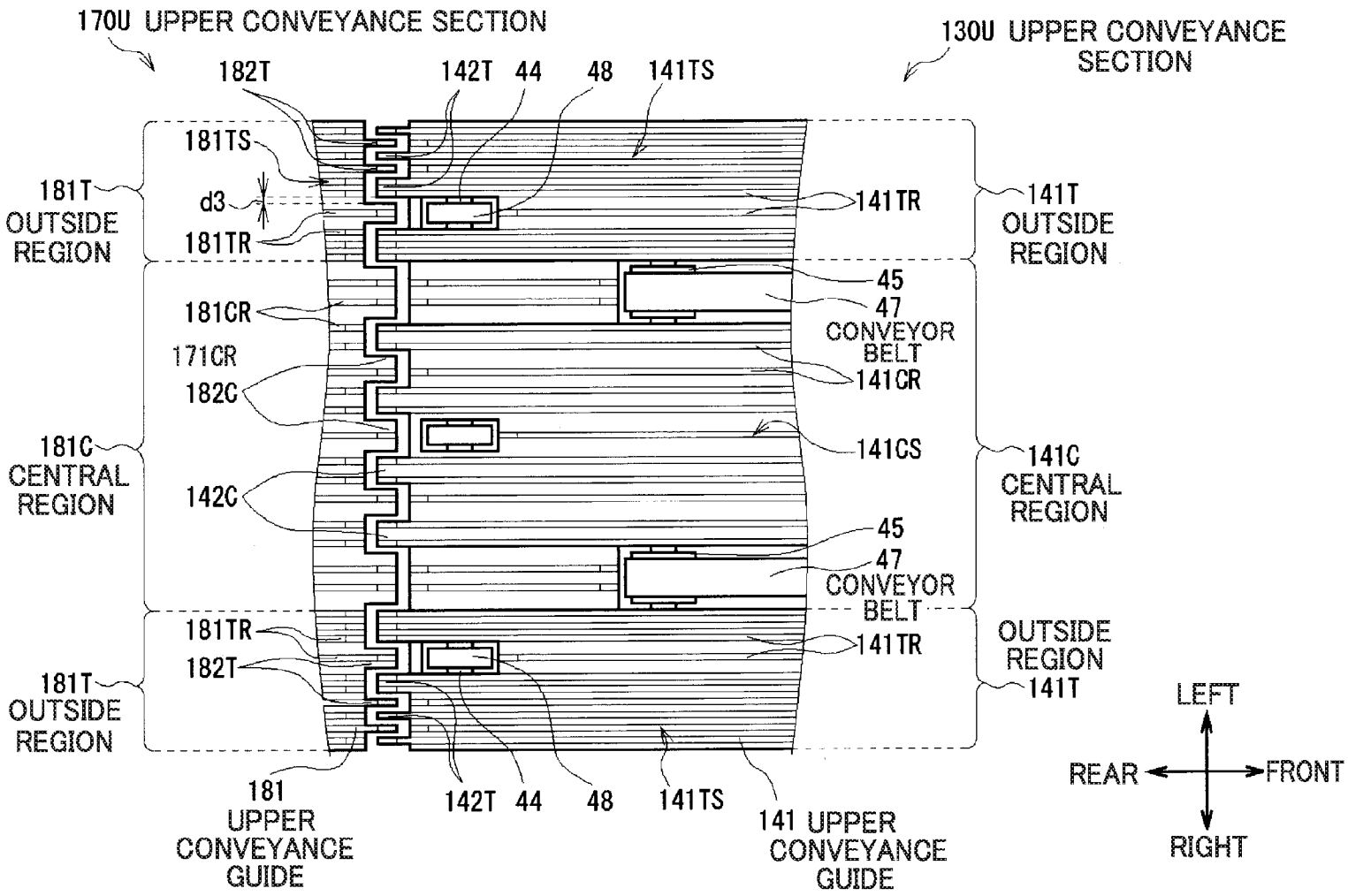
FIG. 16 is a schematic line drawing illustrating a configuration of an upper conveyance section according to the fourth exemplary embodiment.
Figure 17:
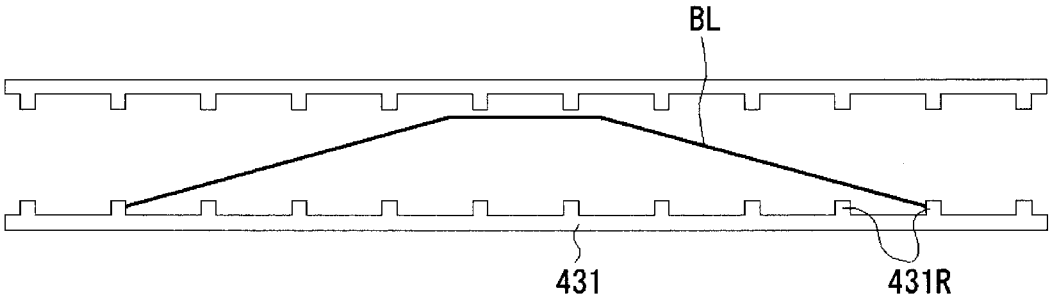
FIG. 17 is a schematic cross-section illustrating a configuration of a conventional conveyance section.

In the above configuration, in the banknote pay-in/pay-out device 310 according to the fourth exemplary embodiment, the lower conveyance guide 171 and the upper conveyance guide 181 that guide banknotes BL in the passing conveyance section 70 of the temporary holding section 16 (FIG. 2) are divided into the central regions 171C and 181C and the outside regions 171T and 181T, similarly to the lower conveyance guide 131 and the upper conveyance guide 141 of the temporary holding conveyance section 130 (FIG. 15, FIG. 16).

The ribs 171CR and 181CR running along the conveyance direction project out from the upper face of the central region 171C and the lower face of the central region 181C. The ribs 171TR and 181TR running along the conveyance direction project out from the upper faces of the outside regions 171T and the lower faces of the outside regions 181T at every spacing d1.

Accordingly, similarly to the temporary holding conveyance section 130, the passing conveyance section 170 enables a reduction in the contact surface area between the outside regions 171T and 181T and the banknotes BL, thereby enabling a reduction in frictional force arising on contact with the banknotes BL. Accordingly, the passing conveyance section 170 enables a reduction in the frictional force that acts on the conveyed banknotes BL, thereby enabling smoother conveyance of banknotes BL than the passing conveyance section 70 according to the third exemplary embodiment.

In the passing conveyance section 170, similarly to in the temporary holding conveyance section 130, the distance d1 that is the left-right direction spacing between the ribs 171TR and 181TR is set very narrow, at approximately 2 mm. Accordingly, similarly to in the case illustrated in FIG. 11, the passing conveyance section 170 enables left-right direction end portions of a banknote BL to be rendered highly unlikely to droop under the force of gravity or the like and enter a gap between the ribs 171TR.

In other respects, the temporary holding conveyance section 130 is capable of similar operation and advantageous effects to the temporary holding conveyance section 130 according to the second exemplary embodiment. Moreover, the passing conveyance section 170 is capable of similar operation and advantageous effects to the passing conveyance section 70 according to the third exemplary embodiment in other respects.

According to the above configuration, in the banknote pay-in/pay-out device 310 according to the fourth exemplary embodiment, the lower conveyance guide 171 and the upper conveyance guide 181 of the passing conveyance section 170 are respectively provided with the ribs 171TR and 181TR projecting out at every distance d1 at the guide faces 171TS of the outside regions 171T and guide faces 181TS of the outside regions 181T. Accordingly, the banknote pay-in/pay-out device 210 is capable of reducing the contact surface area with the guide faces 131TS and 141TS, and 171TS and 181TS, while suppressing the likelihood of left-right direction end portions of the banknotes BL contacting side faces of the ribs 131TR and 141TR, and 171TR and 181TR, in the outside regions 131T and 141T of the temporary holding conveyance section 130, and the outside regions 171T and 181T of the passing conveyance section 170. As a result, the banknote pay-in/pay-out device 210 enables a reduction in the frictional force arising on contact with the banknotes BL, enables wear due to friction with the side faces to be rendered highly unlikely, and also enables stable and smooth conveyance of the banknotes BL.

5. Other Exemplary Embodiments

In the first exemplary embodiment described above, explanation has been given regarding a case in which the upper faces of the outside regions 31T of the lower conveyance guide 31 (namely the guide faces 31TS) and the lower faces of the outside regions 31T of the upper conveyance guide 41 (namely the guide faces 41TS) have profiles that are not formed with large undulations in the left-right direction.

However, the present invention is not limited thereto, and the top and bottom of the conveyance space W may be configured in various combinations. For example, the upper faces of the outside regions 31T of the lower conveyance guide 31 may be configured with a profile that is not formed with large undulations in the left-right direction, while the lower faces of the outside regions 31T of the upper conveyance guide 41 may be provided with ribs projecting out similarly to the ribs 141TR of the upper conveyance guide 141 of the second exemplary embodiment. Similar applies to the second to fourth exemplary embodiments.

In the first exemplary embodiment described above, explanation has been given regarding a case in which the upper faces of the outside regions 31T of the lower conveyance guide 31 have profiles that are not formed with large undulations in the left-right direction across the overall front-rear direction, this being the conveyance direction.

However, the present invention is not limited thereto, and, for example, the upper faces of the outside regions 31T may have profiles that are not formed with large undulations in the left-right direction across only part of the front-rear direction range, and ribs similar to the ribs 141TR of the upper conveyance guide 141 of the second exemplary embodiment may project out over the remainder of the range. Similar applies to the upper conveyance guide 41, and similar applies to the second to fourth exemplary embodiments.

In the second exemplary embodiment described above, explanation has been given regarding a case in which the ribs 131TR formed to the outside regions 131T of the lower conveyance guide 131 have a rectangular cross-section profile, as illustrated in FIG. 8.

However, the present invention is not limited thereto, and configuration may be made with various cross-section profiles, for example triangular or semicircular shapes, or trapezoidal or sine curve shapes. The cross-section profile of the ribs 131TR need not be uniform along the front-rear direction, this being the conveyance direction, and for example, the cross-section profile may change gradually or in stages on progression along the front-rear direction. Similar applies to the ribs 141TR formed to the outside regions 131T of the upper conveyance guide 141, and similar also applies to the ribs 31CR (FIG. 5) formed to the central region 31C and the like in the first to the fourth exemplary embodiments.

In the second exemplary embodiment described above, explanation has been given regarding a case (FIG. 11) in which the distance d1, this being the left-right direction spacing between each of the ribs 131TR projecting out from the outside regions 131T of the lower conveyance guide 131 and the ribs 141TR projecting out from the outside regions 141T of the upper conveyance guide 141, is set to approximately 2 mm.

However, the present invention is not limited thereto, and the distance d1 may be assigned various values, such as approximately 1.5 mm or approximately 2.2 mm. The distance d1 may also vary between the lower conveyance guide 131 side and the upper conveyance guide 141 side. In such cases, although the risk of the left-right direction end portions of the banknotes BL drooping decreases the narrower the distance d1, there is an accompanying increase in the difficulty of manufacturing by injection molding or the like, and in the associated costs. Accordingly, the distance d1 is preferably set appropriately taking into account the properties, such as rigidity, of the banknotes BL, and finding a balance between the material properties of the lower conveyance guide 131, etc. and manufacturing methods and costs. Similar applies to the fourth exemplary embodiment.

In the third exemplary embodiment described above, explanation has been given regarding a case in which the distance d3 between the claw shaped portions 72C and 72T provided to the front ends of the lower conveyance guide 71 and the claw shaped portions 32C and 32T of the lower conveyance guide 31 adjacent thereto in the left-right direction is set at approximately 2 mm, similarly to the distance d1 (FIG. 13).

However, the present invention is not limited thereto, and, similarly to the distance d1, the distance d3 may be assigned various values, such as approximately 1.8 mm or 2.5 mm. The distance d3 may have the same value as the distance d1, or may have a different value. In particular, in the case of the distance d3, since the lower conveyance guide 31 and the lower conveyance guide 71 are molded as different components to each other, there is little need to take into account difficulty of manufacturing, and it is instead desirable to set the distance d3 appropriately in consideration of assembly precision and the like. Similar also applies to the upper conveyance guide 81, and similar also applies to the fourth exemplary embodiment.

In the third exemplary embodiment described above, explanation has been given regarding a case in which the claw shaped portions projecting out from rear end portions of the lower conveyance guide 31 and the upper conveyance guide 41, and from front end portions of the lower conveyance guide 71 and the upper conveyance guide 81, respectively enmesh with each other.

However, the present invention is not limited thereto, and, for example, in cases in which the banknote BL conveyance direction is in the rearward direction only, configuration may be made with various shapes for passing the banknotes BL, such as a shape in which the rear end on the lower conveyance guide 31 side overhangs the front end of the lower conveyance guide 71. Similar applies to the fourth exemplary embodiment.

In the first exemplary embodiment described above, explanation has been given regarding a case in which drive force in the front-rear direction, this being the conveyance direction, is transmitted to the banknotes BL by providing two of the conveyor belts 37 on the left and right inside the central region 31C of the lower conveyance guide 31.

However, the present invention is not limited thereto, and, for example, one, or three or more of the conveyor belts 37 may be provided in the left-right direction inside the central region 31C of the lower conveyance guide 31. The conveyor belts 37 are not limited to within the central region 31C, and may also be provided in the outside regions 31T. In such cases, as long as at least one conveyor belt 37 is disposed in the vicinity of each boundary between the central region 31C and the outside regions 31T, drive force can be transmitted to the banknotes BL irrespective of the positions to which banknotes BL of various sizes handled in the automated teller machine 1 are offset in the conveyance space W. Moreover, plural rollers or the like may be provided in place of the conveyor belts 37 to transmit drive force to the banknotes BL. Similar applies to the upper conveyance guide 41, and similar also applies to the second to the fourth exemplary embodiments.

The present invention is not limited to the exemplary embodiments described above, nor to the other exemplary embodiments. Namely, the scope of application of the present invention covers any combination of some or all of the exemplary embodiments described above and the other exemplary embodiments described above, and exemplary embodiments extrapolated therefrom.

In the first exemplary embodiment described above, explanation has been given regarding a case in which the present invention is applied to the temporary holding conveyance section 30 (FIG. 2) of the conveyance R section 15. However, the present invention is not limited thereto, and, for example, may be applied to sections that convey banknotes BL between the pay-in/pay-out section 12 and identification section 14 in the conveyance R section 15, for example, or to respective sections that convey banknotes BL in the conveyance F section 13 and the conveyance M section 17. Similar applies to the second exemplary embodiment. The present invention as described in the third and fourth exemplary embodiments may also be applied to respective sections that perform banknote BL conveyance and passing, such as a section that passes banknotes BL between the conveyance F section 13 and the identification section 14.

In the first exemplary embodiment described above, explanation has been given regarding a case in which the present invention is applied to the temporary holding conveyance section 30 of the conveyance R section 15 that conveys the banknotes BL as a medium in the banknote pay-in/pay-out device 10 of the automated teller machine 1 that performs cash transaction processing with a customer. However, there is no limitation thereto, and the present invention may be applied to various locations that convey a medium in devices that handle various paper sheet shaped media including various cash vouchers, securities, tickets or slips. Similar also applies to the second to the fourth exemplary embodiments.

In the first exemplary embodiment described above, explanation has been given regarding a case in which the temporary holding conveyance section 30 serving as a medium conveyance device is configured by the lower conveyance guide 31 serving as a conveyance guide, and the outside regions 31T serving as outside regions.

However, the present invention is not limited thereto, and a medium conveyance device may be configured by conveyance guides and outside regions of various other configurations.

In the third exemplary embodiment described above, explanation has been given regarding a case in which, in the automated teller machine 201 serving as a medium transaction device including the temporary holding conveyance section 30 as a first conveyance section and the passing conveyance section 70 as a second conveyance section, the first conveyance section is configured by the lower conveyance guide 31 serving as a first conveyance guide, and the outside regions 31T serving as first outside regions, and the second conveyance section is configured by the lower conveyance guide 71 serving as a second conveyance guide, and the outside regions 71T serving as second outside regions.

However, the present invention is not limited thereto, and a first conveyance section may be configured by a first conveyance guide and a first outside region, and a second conveyance guide may be configured by a second conveyance guide and a second outside region, in medium transaction devices including first conveyance sections and second conveyance sections of various other configurations.

INDUSTRIAL APPLICABILITY

The present invention may be utilized in various devices that convey a paper sheet shaped medium along a conveyance direction.

The entire disclosure of Japanese Patent Application No. 2013-194600 is incorporated by reference in the present specification. All cited documents, patent applications and technical standards mentioned in the present specification are incorporated by reference in the present specification to the same extent as if the individual cited document, patent application, or technical standard was specifically and individually indicated to be incorporated by reference.

The invention claimed is:

1. A medium conveyance device comprising:

a conveyance guide that defines a conveyance space configured to convey a paper sheet shaped medium along a conveyance direction, wherein the conveyance guide comprises:

a central region configured to guide a central portion of the medium along the conveyance direction, the central portion being central in the orthogonal direction orthogonal to the conveyance direction; and an outside region located outward from the central region in the orthogonal direction orthogonal to the conveyance direction, the outside region configured relative to the central region so as to be contacted by an orthogonal end portion of the medium in the orthogonal direction orthogonal to the conveyance direction, and the outside region configured to guide the orthogonal end portion of the medium so as to be positioned inside the conveyance space;

an adjacent conveyance guide that is disposed adjacent to the conveyance guide along the conveyance direction; and an adjacent outside region adjacent to the outside region along the conveyance direction and configured to be contacted by the orthogonal end portion of the medium, and configured to guide the end portion of the medium so as to be positioned inside the conveyance space, wherein the outside region has a flat surface, such that the outside region is formed without ribs extending in the conveyance direction, the central region includes ribs extending in the conveyance direction, top surfaces of the ribs having a same height as the flat surface of the outside region, the adjacent conveyance guide further comprises a plurality of first projections projecting out toward a side of the conveyance guide, the plurality of first projections separated from one another along the orthogonal direction, and the conveyance guide further includes a plurality of second projections projecting out toward a side of the adjacent conveyance guide, the plurality of second projections separated from one another along the orthogonal direction such that the plurality of second projections of the conveyance guide interlock with the plurality of first projections of the adjacent conveyance guide.

2. The medium conveyance device of claim 1, wherein, in the outside region, a face that contacts the medium has a shape that contacts a portion of the medium other than an orthogonal direction end face.

3. A medium conveyance device, comprising:

a conveyance guide that defines a conveyance space configured to convey a paper sheet shaped medium along a conveyance direction, wherein the conveyance guide comprises:

a central region configured to guide a central portion of the medium along the conveyance direction, the central portion being central in the orthogonal direction orthogonal to the conveyance direction; and an outside region located outward from the central region in the orthogonal direction orthogonal to the conveyance direction, the outside region configured relative to the central region so as to be contacted by an orthogonal end portion of the medium in the orthogonal direction orthogonal to the conveyance direction, and the outside region configured to guide the orthogonal end portion of the medium so as to be positioned inside the conveyance space; and a drive transmission section disposed between the outside region and the central region, the drive transmission section configured to transmit drive force to the medium, wherein the outside region has a flat surface, such that the outside region is formed without ribs extending in the conveyance direction, and the central region includes ribs extending in the conveyance direction, top surfaces of the ribs having a same height as the flat surface of the outside region.

4. A medium transaction device configured to convey a paper sheet shaped medium between a first conveyance section and a second conveyance section, wherein:

the first conveyance section comprises a first conveyance guide that defines a conveyance space for conveying the paper sheet shaped medium through the conveyance space along a conveyance direction, the first conveyance section comprising:

a first central region configured to convey a central portion of the medium along the conveyance space, the central portion being central in the orthogonal direction orthogonal to the conveyance direction; and a first outside region located outward from the first central region in the orthogonal direction orthogonal to the conveyance direction, the first outside region configured relative to the first central region so as to be contacted by an orthogonal end portion of the medium in the orthogonal direction orthogonal to the conveyance direction, the first outside region configured to guide the orthogonal end portion of the medium so as to be positioned inside the conveyance space;

the second conveyance section comprises a second conveyance guide that is disposed adjacent to the first conveyance guide along the conveyance direction, the second conveyance section comprising:

a second central region configured to convey the central portion of the medium along the conveyance space, the central portion being central in the orthogonal direction orthogonal to the conveyance direction; and a second outside region located outward from the second central region in the orthogonal direction orthogonal to the conveyance direction, the second outside region configured relative to the second central region so as to be contacted by the orthogonal end portion of the medium, the second outside region configured to guide the orthogonal end portion of the medium so as to be positioned inside the conveyance space, wherein the first outside region has a flat surface, such that the first outside region is formed without ribs extending in the conveyance direction, and the first central region includes ribs extending in the conveyance direction, top surfaces of the ribs having a same height as the flat surface of the first outside region.

* * * * *